US012473667B2

(12) United States Patent
Cascio et al.

(10) Patent No.: US 12,473,667 B2
(45) Date of Patent: Nov. 18, 2025

(54) SYSTEMS AND METHODS TO PROVIDE COLOR ENHANCED YARNS

(71) Applicant: Aladdin Manufacturing Corporation, Calhoun, GA (US)

(72) Inventors: Anthony Cascio, Calhoun, GA (US); James Mason, Summerville, GA (US); Lucinda Jones, Calhoun, GA (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 723 days.

(21) Appl. No.: 17/349,696

(22) Filed: Jun. 16, 2021

(65) Prior Publication Data

US 2021/0388539 A1 Dec. 16, 2021

Related U.S. Application Data

(60) Provisional application No. 63/039,637, filed on Jun. 16, 2020, provisional application No. 63/039,626, (Continued)

(51) Int. Cl.
*D02G 3/34* (2006.01)
*D01H 1/14* (2006.01)
(Continued)

(52) U.S. Cl.
CPC ..... *D02G 3/346* (2013.01); *D01H 1/14* (2013.01); *D02G 3/24* (2013.01); *D05C 17/026* (2013.01)

(58) Field of Classification Search
CPC . D02G 3/346; D02G 3/24; D01H 1/14; D05C 17/026
See application file for complete search history.

(56) References Cited

U.S. PATENT DOCUMENTS 3,930,782 A 1/1976 Bigland
4,112,561 A 9/1978 Norris et al.
(Continued)

FOREIGN PATENT DOCUMENTS

CA 2256050 A1 6/1999
GB 1275572 A 5/1975
(Continued)

OTHER PUBLICATIONS

International Search Report and Written Opinion issued in PCT/US2022/026128, mailed Jul. 29, 2022 (8 pages).
(Continued)

*Primary Examiner* — Galen H Hauth
*Assistant Examiner* — John Robitaille
(74) *Attorney, Agent, or Firm* — Meunier Carlin & Curfman LLC

(57) ABSTRACT

Systems and methods for producing BCF yarns include providing at least one color enhancement method for enhancing the color and/or hue of at least one of the N bundles of filaments. The color enhancement methods include tacking one or more of the bundles of spun filaments prior to and/or during drawing, texturizing one or more bundles of spun filaments individually from the other bundles of spun filaments, providing intermediate tacking of at least one bundle of texturized filaments and feeding the tacked and texturized filaments to a mixing cam for positioning tacked and texturized bundles relative one to the other before reaching the final tacking device, or combinations thereof.

25 Claims, 9 Drawing Sheets

Related U.S. Application Data filed on Jun. 16, 2020, provisional application No. 63/039,630, filed on Jun. 16, 2020.

(51) Int. Cl.
*D02G 3/24* (2006.01)
*D05C 17/02* (2006.01)

(56) References Cited

U.S. PATENT DOCUMENTS

| | | | | |
|---|---|---|---|---|
| 4,216,735 | A | 8/1980 | McDaniel | |
| 4,708,619 | A | 11/1987 | Balk | |
| 4,789,507 | A | 12/1988 | Wesley et al. | |
| 5,131,918 | A | 7/1992 | Kelley | |
| 5,160,347 | A | 11/1992 | Kay et al. | |
| 5,234,650 | A | 8/1993 | Hagen et al. | |
| 5,362,563 | A | 11/1994 | Lin | |
| 5,549,957 | A | 8/1996 | Negola et al. | |
| 5,834,089 | A | 11/1998 | Jones et al. | |
| 5,902,531 | A | 5/1999 | Berger et al. | |
| 5,958,548 | A | 9/1999 | Negola et al. | |
| 5,996,328 | A * | 12/1999 | King | D02G 3/34 57/352 |
| 6,076,345 | A | 6/2000 | Weiss et al. | |
| 6,085,395 | A | 7/2000 | Weiss | |
| 6,113,825 | A * | 9/2000 | Chuah | D01F 6/62 264/210.8 |
| 6,119,320 | A | 9/2000 | Weiss | |
| 6,120,715 | A | 9/2000 | Weigend | |
| 6,257,512 | B1 | 7/2001 | Schoeck et al. | |
| 6,383,432 | B1 | 5/2002 | Nakajima et al. | |
| 6,406,650 | B1 * | 6/2002 | Gross | D01D 1/065 425/382.2 |
| 6,900,547 | B2 | 5/2005 | Polk, Jr. et al. | |
| 7,086,130 | B2 | 8/2006 | Jahns et al. | |
| 7,651,540 | B2 | 1/2010 | Rao | |
| 7,845,923 | B2 | 12/2010 | Lennemann et al. | |
| 8,182,550 | B1 | 5/2012 | Hayes | |
| 8,597,553 | B1 | 12/2013 | Clark | |
| 9,550,338 | B2 | 1/2017 | Clark | |
| 2002/0073684 | A1 | 6/2002 | Simmen | |
| 2003/0042651 | A1 | 3/2003 | Najour et al. | |
| 2005/0008855 | A1 | 1/2005 | Figuly et al. | |
| 2005/0048253 | A1 | 3/2005 | Nord et al. | |
| 2005/0048281 | A1 | 3/2005 | Royer et al. | |
| 2005/0106391 | A1 * | 5/2005 | Lawrence | D01F 6/04 425/8 |
| 2006/0049542 | A1 | 3/2006 | Chu et al. | |
| 2006/0144033 | A1 * | 7/2006 | Lee | D02G 3/286 57/1 R |
| 2009/0208695 | A1 | 8/2009 | Funatsu et al. | |
| 2010/0256319 | A1 | 10/2010 | Pereira De Lacerda et al. | |
| 2010/0297442 | A1 | 11/2010 | Kalies et al. | |
| 2012/0034838 | A1 | 2/2012 | Li et al. | |
| 2013/0200544 | A1 | 8/2013 | Hahm et al. | |
| 2013/0315029 | A1 | 11/2013 | Helbing et al. | |
| 2015/0275400 | A1 | 10/2015 | Tung | |
| 2018/0363239 | A1 | 12/2018 | Love et al. | |
| 2019/0085483 | A1 | 3/2019 | Clark | |
| 2019/0105283 | A1 | 4/2019 | Anderson et al. | |
| 2019/0315962 | A1 | 10/2019 | Booth et al. | |
| 2019/0360129 | A1 | 11/2019 | Nasri et al. | |
| 2020/0102698 | A1 | 4/2020 | Lu | |
| 2020/0115824 | A1 | 4/2020 | Stündl et al. | |
| 2020/0291547 | A1 | 9/2020 | Fischer et al. | |
| 2020/0324454 | A1 | 10/2020 | Sauer | |
| 2021/0388531 | A1 | 12/2021 | Cascio et al. | |
| 2021/0388540 | A1 | 12/2021 | Cascio et al. | |

FOREIGN PATENT DOCUMENTS

| | | | |
|---|---|---|---|
| JP | 3088597 | B2 | 4/1995 |
| JP | 2005060850 | A | 3/2005 |
| WO | 1995014806 | A1 | 6/1996 |
| WO | 2001073189 | A1 | 10/2001 |
| WO | 2007121696 | A1 | 11/2007 |
| WO | 2009037118 | A1 | 3/2009 |
| WO | 2015039971 | A1 | 3/2015 |
| WO | 2020123127 | A1 | 6/2020 |
| WO | 2021257738 | A1 | 12/2021 |
| WO | 2021257739 | A1 | 12/2021 |

OTHER PUBLICATIONS

International Search Report and Written Opinion issued in PCT/US2021/037684, dated Nov. 1, 2021.

International Search Report and Written Opinion issued in PCT/US2021/037673, dated Nov. 9, 2021.

International Search Report and Written Opinion issued in PCT/US2021/037687, dated Nov. 1, 2021.

Terry, BCF—Bulk Continuous Filament Carpet Fiber, Feb. 5, 2018, [retrieved from the Internet on Aug. 2, 2021 at <https://www.baneclene.com/professionals/Content.aspx?xps=NTY1>] para 1.

International Search Report and Written Opinion issued in PCT/US2019/062873, dated Feb. 7, 2020.

Extended European Search Report completed Jul. 15, 2019 in related European application EP 19152387.7 (7 pages).

International Search Report and Written Opinion issued in PCT/US2021/063605, mailed Mar. 8, 2022, 15 pages.

Non-Final Office Action in co-pending U.S. Appl. No. 17/349,699, mailed Aug. 17, 2023, 17 pages.

Non-Final Office Action issued in U.S. Appl. No. 17/349,731, mailed Apr. 3, 2024.

Non-Final Office Action issued in U.S. Appl. No. 17/413,356, mailed May 16, 2024.

* cited by examiner

SYSTEMS AND METHODS TO PROVIDE COLOR ENHANCED YARNS

BACKGROUND

Bulked continuous filament (BCF) yarns are known for use in tufting carpets. There is a demand for yarns having varying colors along their length to provide a certain type of rather randomly colored carpet surfaces.

Typically, such yarns fit for this purpose are made by space dying white yarns or a yarn with a base color after producing these yarns. Space dying is a post-production process, which adds time and cost to the overall process, and the dye may not seep through the entire cross section of the filament, which can have a negative impact on the appearance where the filament is cut and can result in color fading over time.

Thus, there is a need in the art for improved BCF yarns and other yarns for use in tufting carpets.

BRIEF SUMMARY

It is an object of the present invention to provide yarns with varying color along its length, which has locally more pronounced (or visible) colors.

Dependent on the position of the filaments along the surface of the yarn, the yarn may have a gradient of colors, hues, and/or dyability characteristics along its axial length. An advantage of various embodiments is to have more pronounced variations of color and/or hues along the axial length of the yarn. The yarn may be a bulked continuous filament (BCF) yarn that may be (1) extruded and drawn in a continuous operation, (2) extruded, drawn, and textured in a continuous operation, (3) extruded and taken up in one step and is then later unwound, drawn, and textured in another step, or (4) extruded, drawn, and textured in one or more operations.

In addition, the BCF yarn or multi-step produced yarn could be used as yarn in a carpet, such as a tufted carpet, or in apparel, for example.

The above objective is accomplished by processes and system according to various implementations of the present invention.

According to a first aspect, a method to produce a BCF yarn comprises: A. providing N bundles of spun filaments, N being an integer of 2 or more; B. elongating said N bundles of spun filaments; C. texturizing said N bundles of elongated spun filaments; and D. tacking said N bundles of texturized spun filaments to provide a BCF yarn, wherein prior or during step B, at least a first of said N bundles of spun filaments is tacked individually.

According to some embodiments, all of said N bundles of spun filaments are tacked individually.

According to some embodiments, each of the N bundles of spun filaments are elongated partially prior to said tacking, after which tacking, the N bundles are drawn to final titer.

According to some embodiments, wherein the length between consecutive tacks on each bundle is between 5 and 50 mm.

According to some embodiments, the filaments of at least one of the N bundles of spun filaments has a different color, hue, and/or dyability characteristic as compared to the color, hue, and/or dyability characteristic of another of the N bundles of spun filaments.

According to some embodiments, the filaments of each of the N bundles of spun filaments has a different color, hue, and/or dyability characteristic as compared to the color, hue, and/or dyability characteristic of the other N bundles of spun filaments.

According to some embodiments, a BCF yarn is produced according to the method of the first aspect.

According to some embodiments, a carpet comprises pile, and the pile is made with the BCF yarn produced according to the method according to the first aspect.

According to a second aspect, a method to produce a BCF yarn comprises: A. providing N bundles of spun filaments, N being an integer of 2 or more; B. elongating said N bundles of spun filaments; C. texturizing said N bundles of elongated spun filaments; and D. tacking said N bundles of texturized spun filaments to provide a BCF yarn, wherein in step C, at least a first bundle of said N bundles of elongated spun filaments is texturized separately from the other of said N bundles of elongated spun filaments.

According to some embodiments, in step C, all of said N bundles of elongated spun filaments are texturized separately.

According to some embodiments, prior or during step B, at least the first bundle is tacked separately from the other N bundles of spun filaments.

According to some embodiments, wherein all of said N bundles of spun filaments are tacked individually prior or during step B.

According to some embodiments, the filaments of at least one of the N bundles of spun filaments has a different color, hue, and/or dyability characteristic as compared to the color and/or hue of another of the N bundles of spun filaments.

According to some embodiments, the filaments of each of the N bundles of spun filaments has a different color, hue, and/or dyability characteristic as compared to the color, hue, and/or dyability characteristic of the other N bundles of spun filaments.

According to some embodiments, a BCF yarn is produced according to the method of the second aspect.

According to some embodiments, a carpet comprises pile, and the pile is made with the BCF yarn produced according to the method according to the second aspect.

According to a third aspect, a method to produce a BCF yarn comprises: A. providing N bundles of spun filaments, N being an integer of 2 or more; B. elongating said N bundles of spun filaments; C. texturizing said N bundles of elongated spun filaments; and D. tacking said N bundles of texturized spun filaments to provide a BCF yarn, wherein between step C and D, the filaments of at least one of said N bundles of texturized spun filaments are tacked individually.

According to some embodiments, said tacked bundle of texturized spun filaments and the other of said N bundles of texturized spun filaments are guided over a mixing cam to position bundles relative to each other before the final tacking in step D.

According to some embodiments, the mixing cam is rotated while the textured spun filaments are guided over the mixing cam, varying the position of the bundles relative to each other before the final tacking step in step D.

According to some embodiments, the mixing cam is stationary while the textured spun filaments are guided over the mixing cam.

According to some embodiments, prior to and/or during step B, at least one of said N bundles of spun filaments are tacked individually.

According to some embodiments, prior to and/or during step B, each of said N bundles of spun filaments are tacked individually.

According to some embodiments, in step C, at least a first bundle of said N bundles of elongated spun filaments is texturized separately from the other of said N bundles of elongated spun filaments.

According to some embodiments, in step C, all of said N bundles of elongated spun filaments are texturized separately.

According to some embodiments, the filaments of at least one of the N bundles of spun filaments has a different color, hue, and/or dyability characteristic as compared to the color, hue, and/or dyability characteristic of another of the N bundles of spun filaments.

According to some embodiments, the filaments of each of the N bundles of spun filaments has a different color, hue, and/or dyability characteristic as compared to the color, hue, and/or dyability characteristic of the other N bundles of spun filaments.

According to some embodiments, a yarn is produced according to the method according to the third aspect. In some embodiments, the yarn is a BCF yarn.

According to some embodiments, a carpet comprises pile, and the pile is made with the yarn produced according to the third aspect.

According to some embodiments, a yarn is produced according to the method according to the first aspect combined with the method according to the second aspect. And, according to some embodiments, a carpet comprises pile, and the pile is made with the yarn produced according to the method according to the first aspect combined with the method according to the second aspect.

According to some embodiments, a yarn is produced according to the method according to the first aspect combined with the method according to the third aspect. And, according to some embodiments, a carpet comprises pile, and the pile is made with the yarn produced according to the method according to the first aspect combined with the method according to the third aspect.

According to some embodiments, a yarn is produced according to the method according to the second aspect combined with the method according to the third aspect. And, according to some embodiments, a carpet comprises pile, and the pile is made with the yarn produced according to the method according to the second aspect combined with the method according to the third aspect.

According to some embodiments, a yarn is produced according to the method according to the first aspect combined with the method according to the second aspect and the method according to the third aspect. And, according to some embodiments, a carpet comprises pile, and the pile is made with the yarn produced according to the method according to the first aspect combined with the method according to the second aspect and the method according to the third aspect.

According to an fourth aspect, a yarn spinning system comprises: A. a spin plate for spinning N bundles of spun filaments, N being an integer of 2 or more; B. at least one drawing device to elongate said N bundles of spun filaments; C. at least one texturizer to texturize said N bundles of elongated spun filaments; and D. a final tacking device to tack said N bundles of texturized spun filaments to provide a yarn, wherein said system further comprises an initial tacking device upstream to or integrated within the at least drawing device to tack at least one of said N bundles of spun filaments prior or during the elongation of the N bundles of spun filaments.

According to some embodiments, the at least one texturizer comprises at least a first texturizer and a second texturizer, and at least one of said N bundles of spun filaments is texturized individually from the other N bundles of spun filaments through the first texturizer.

According to some embodiments, the at least one texturizer comprises N texturizers, and each of said N bundles of spun filaments are texturized individually from each other through respective N texturizers.

According to some embodiments, the system further comprises an intermediate tacking device disposed between the at least one texturizer and the final tacking device, the intermediate tacking device for tacking at least one of said N bundles of texturized spun filaments.

According to some embodiments, the system further comprises a mixing cam disposed between the at least one texturizer and the final tacking device, the mixing cam for positioning tacked and texturized bundles relative to each other before reaching the final tacking device.

According to some embodiments, the mixing cam is rotated while the textured spun filaments are guided over the mixing cam, varying the position of the bundles relative to each other before the final tacking step in step D.

According to some embodiments, the mixing cam is stationary while the textured spun filaments are guided over the mixing cam.

According to some embodiments, the filaments of at least one of the N bundles of spun filaments has a different color, hue, and/or dyability characteristic as compared to the color, hue, and/or dyability characteristic of another of the N bundles of spun filaments.

According to some embodiments, the filaments of each of the N bundles of spun filaments has a different color, hue, and/or dyability characteristic as compared to the color, hue, and/or dyability characteristic of the other N bundles of spun filaments.

According to a fifth aspect, a BCF yarn spinning system comprises A. a spin plate for spinning N bundles of spun filaments, N being equal or more than 2; B. at least one drawing device to elongate said N bundles of spun filaments; C. at least a first texturizer and a second texturizer, wherein at least one of said N bundles of elongated spun filaments is texturized individually through the first texturizer separately from the other said N bundles of elongated spun filaments; and D. a final tacking device to tack said N bundles of texturized spun filaments to provide a BCF yarn.

According to some embodiments, the system further comprises N texturizers, wherein N texturizers includes the first texturizer and the second texturizer, and each of said N bundles of elongated spun filaments are texturized individually from the other of the N bundles of elongated spun filaments through respective N texturizers.

According to some embodiments, the system further comprising a second tacking device disposed between the texturizers and the final tacking device, the second tacking device for tacking at least one of said N bundles of texturized spun filaments.

According to some embodiments, the system further comprises a mixing cam disposed between the texturizers and the final tacking device, the mixing cam for positioning tacked and texturized bundles relative to each other before reaching the final tacking device.

According to some embodiments, the mixing cam is rotated while the textured spun filaments are guided over the mixing cam, varying the position of the bundles relative to each other reaching the final tacking device.

According to some embodiments, the mixing cam is stationary while the textured spun filaments are guided over the mixing cam.

According to some embodiments, the filaments of at least one of the N bundles of spun filaments has a different color, hue, and/or dyability characteristic as compared to the color, hue, and/or dyability characteristic of another of the N bundles of spun filaments.

According to some embodiments, the filaments of each of the N bundles of spun filaments has a different color, hue, and/or dyability characteristic as compared to the color, hue, and/or dyability characteristic of the other N bundles of spun filaments.

According to a sixth aspect, a BCF yarn spinning system comprises: A. a spin plate for spinning N bundles of spun filaments, N being an integer of 2 or more; B. at least one drawing device to elongate said N bundles of spun filaments; C. at least one texturizer to texturize said N bundles of elongated spun filaments; D. a second tacking device disposed between the texturizers and the final tacking device, the second tacking device for tacking at least one of said N bundles of texturized spun filaments; and E. a final tacking device to tack said N bundles of texturized spun filaments to provide a BCF yarn.

According to some embodiments, the system further comprises a mixing cam disposed between the second tacking device and the final tacking device, the mixing cam for positioning tacked and texturized bundles relative to each other before reaching the final tacking device.

According to some embodiments, the mixing cam is rotated while the textured spun filaments are guided over the mixing cam, varying the position of the bundles relative to each other reaching the final tacking device.

According to some embodiments, the mixing cam is stationary while the textured spun filaments are guided over the mixing cam.

According to some embodiments, the filaments of at least one of the N bundles of spun filaments has a different color, hue, and/or dyability characteristic as compared to the color, hue, and/or dyability characteristic of another of the N bundles of spun filaments.

According to some embodiments, the filaments of each of the N bundles of spun filaments has a different color, hue, and/or dyability characteristic as compared to the color, hue, and/or dyability characteristic of the other N bundles of spun filaments.

According to a sixth aspect, a BCF yarn spinning system comprises: A. a spin plate for spinning N bundles of spun filaments, N being an integer of 2 or more; B. at least one drawing device to elongate said N bundles of spun filaments; C. at least one texturizer to texturize said N bundles of elongated spun filaments; D. a second tacking device disposed between the texturizers and the final tacking device, the second tacking device for tacking at least one of said N bundles of texturized spun filaments; and E. a final tacking device to tack said N bundles of texturized spun filaments to provide a BCF yarn.

According to a seventh independent aspect, a yarn is provided comprising two or more bundles of spun filaments, wherein said bundles comprise individual tack points, where the filaments of the respective bundle are tacked together. In some embodiments, the yarn is BCF yarn. In some embodiments, said bundles of filaments may further comprise a common tack point where the filaments of all bundles are tacked together. In some embodiments, the position of the bundles relative to each other is varied at consecutive common tacking points. In some embodiments, two or more bundles along their length comprises one or more individual tacks in between said common tacks. In some embodiments, said two or more bundles of spun filaments may comprise an individual texture, e.g., the bundles may have been texturized separately. In some embodiments, the filaments of at least one of said bundles of spun filaments has a different color, hue, and/or dyability characteristic as compared to the color, hue, and/or dyability characteristic of another of the bundles of spun filaments. It is clear that the yarn of the seventh aspect may be or may not be obtained through a method in accordance with the first, second and/or third aspects and/or by using a spinning system in accordance with the fourth, fifth or sixth aspect as mentioned above. The yarn of the seventh aspect may show characteristics similar or equal to those of the yarns obtained through these methods or spinning systems, without necessarily having been obtained in that way.

The yarn of the seventh aspect may have a varying color or hue along the length of the yarn. The claimed individual and common tacking points improve the rendition or richness of the colors.

In some embodiments, the filaments of said two or more bundles of the yarn of the seventh aspect are solid dyed (also referred to as solution dyed) filaments. Such filaments comprise their respective color all through their cross-section and are better wear resistant, while providing a better color rendition when being cut through to from a cut pile. In some embodiments, thus, the filaments or bundles are spun from a colored polymer, such as PET (polyethylene terephtalate), PTT (poly trimethylene terephthalate), PP (polypropylene) or PA (polyamide). In some embodiments, the yarn comprises at least two bundles of differently colored filaments, wherein the difference in color or hue is such that it can be expressed with a Delta E value larger than 1.0. For example, in some embodiments, the Delta E value is at least 5.0 or at least 10.0. In some embodiments, the respective filaments or bundles are colored uniformly in their length. A variation in color and/or hue is obtained through the provision of the individual and/or common tacks between the differently colored bundles as provided for by the seventh aspect, as well as through the individual textures.

According to an eighth independent aspect, a carpet, rug, or carpet tile (collectively referred to herein as "carpet") is provided comprising a pile formed from a yarn in accordance with the seventh independent aspect.

The independent and dependent claims set out particular and preferred features of the invention. Features from the dependent claims may be combined with features of the independent or other dependent claims, and/or with features set out in the description above and/or hereinafter as appropriate.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

Example features and implementations are disclosed in the accompanying drawings. However, the present disclosure is not limited to the precise arrangements shown, and the drawings are not necessarily drawn to scale.

DETAILED DESCRIPTION

Figure 1:
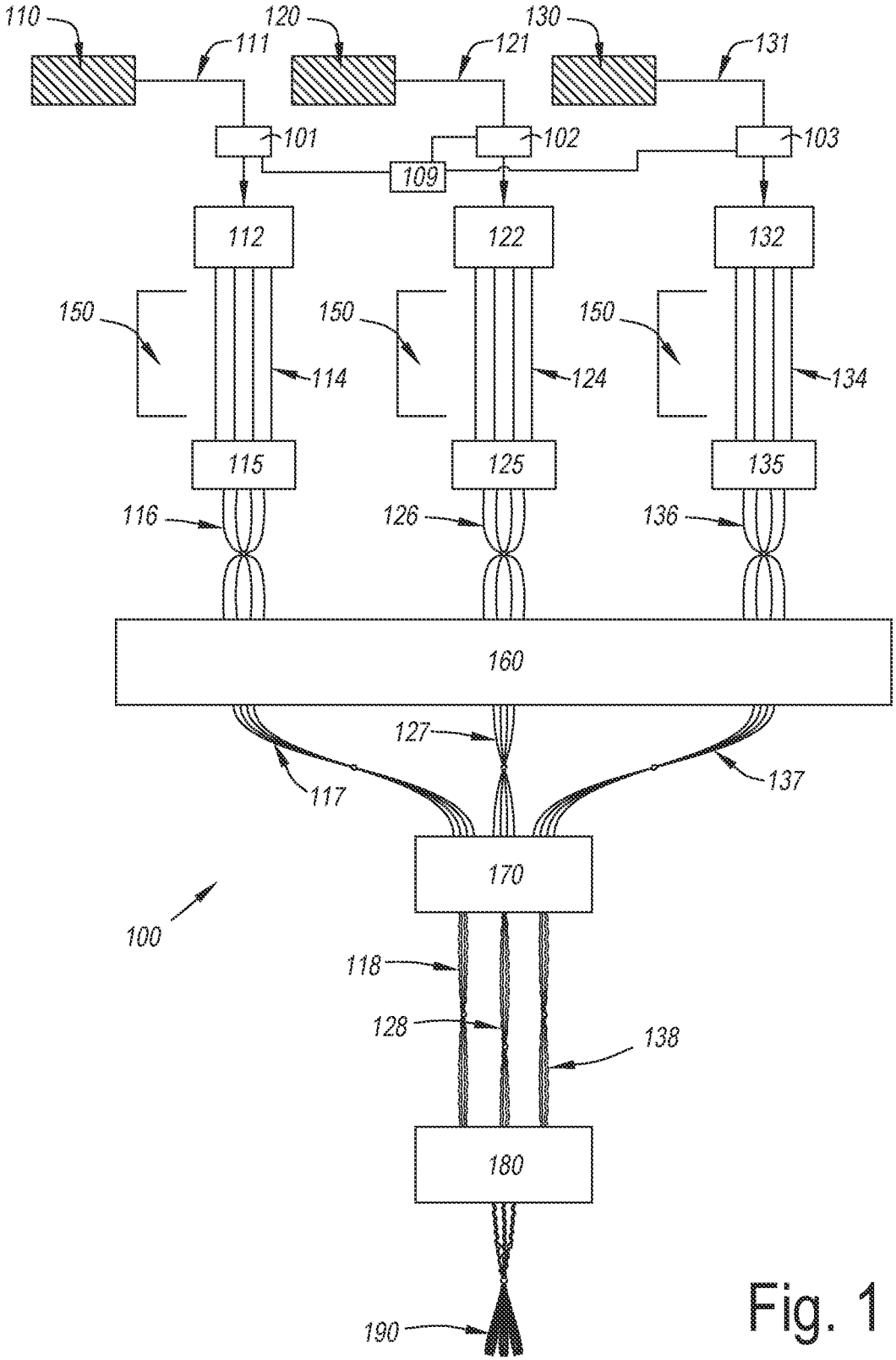
FIG. 1 illustrates a schematic diagram of a system according to one implementation.

Various implementations are described with respect to particular embodiments. It is to be noticed that the term "comprising", used in the claims, should not be interpreted as being restricted to the means listed thereafter; it does not exclude other elements or steps. It is thus to be interpreted as specifying the presence of the stated features, steps or components as referred to, but does not preclude the presence or addition of one or more other features, steps or components, or groups thereof.

Throughout this specification, reference to "one embodiment" or "an embodiment" (or "one implementation" or "an implementation") are made. Such references indicate that a particular feature, described in relation to the embodiment is included in at least one embodiment of the inventions disclosed herein. Thus, appearances of the phrases "in one embodiment" or "in an embodiment" (or "in one implementation" or "in an implementation") in various places throughout this specification are not necessarily all referring to the same embodiment, though they could.

Furthermore, the particular features or characteristics may be combined in any suitable manner in one or more embodiments, as would be apparent to one of ordinary skill in the art.

According to a first aspect, a method to produce a BCF yarn comprises: A. providing N bundles of spun filaments, N being an integer of 2 or more; B. elongating said N bundles of spun filaments; C. texturizing said N bundles of elongated spun filaments; and D. tacking said N bundles of texturized spun filaments to provide a BCF yarn, wherein prior or during step B, at least a first of said N bundles of spun filaments is tacked individually.

According to a second aspect, a method to produce a BCF yarn comprises: A. providing N bundles of spun filaments, N being an integer of 2 or more; B. elongating said N bundles of spun filaments; C. texturizing said N bundles of elongated spun filaments; and D. tacking said N bundles of texturized spun filaments to provide a BCF yarn, wherein in step C, at least a first bundle of said N bundles of elongated spun filaments is texturized separately from the other of said N bundles of elongated spun filaments.

According to a third aspect, a method to produce a BCF yarn comprises: A. providing N bundles of spun filaments, N being an integer of 2 or more; B. elongating said N bundles of spun filaments; C. texturizing said N bundles of elongated spun filaments; and D. tacking said N bundles of texturized spun filaments to provide a BCF yarn, wherein between step C and D, the filaments of at least one of said N bundles of texturized spun filaments are tacked individually.

According to an fourth aspect, a BCF yarn spinning system comprises: A. a spin plate for spinning N bundles of spun filaments, N being an integer of 2 or more; B. at least one drawing device to elongate said N bundles of spun filaments; C. at least one texturizer to texturize said N bundles of elongated spun filaments; and D. a final tacking device to tack said N bundles of texturized spun filaments to provide a BCF yarn, wherein said system further comprises an initial tacking device upstream to or integrated within the at least drawing device to tack at least one of said N bundles of spun filaments prior or during the elongation of the N bundles of spun filaments.

According to a fifth aspect, a BCF yarn spinning system comprises A. a spin plate for spinning N bundles of spun filaments, N being equal or more than 2; B. at least one drawing device to elongate said N bundles of spun filaments; C. at least a first texturizer and a second texturizer, wherein at least one of said N bundles of elongated spun filaments is texturized individually through the first texturizer separately from the other said N bundles of elongated spun filaments; and D. a final tacking device to tack said N bundles of texturized spun filaments to provide a BCF yarn.

According to a sixth aspect, a BCF yarn spinning system comprises: A. a spin plate for spinning N bundles of spun filaments, N being an integer of 2 or more; B. at least one drawing device to elongate said N bundles of spun filaments; C. at least one texturizer to texturize said N bundles of elongated spun filaments; D. a second tacking device disposed between the texturizers and the final tacking device, the second tacking device for tacking at least one of said N bundles of texturized spun filaments; and E. a final tacking device to tack said N bundles of texturized spun filaments to provide a BCF yarn.

According to a seventh independent aspect, a yarn is provided comprising two or more bundles of spun filaments, wherein said bundles comprise individual tack points, where the filaments of the respective bundle are tacked together.

According to an eighth independent aspect, a carpet, rug, or carpet tile (collectively referred to herein as "carpet") is provided comprising a pile formed from a yarn in accordance with the seventh independent aspect.

FIG. 1 illustrates a schematic of a system for producing BCF yarn according to one implementation. The system 100 includes three extruders 110, 120 and 130, three spin stations that each include a spin plate 112, 122 and 132 and a pump 101, 102, 103, a processor 109, quenchers 150, tacking devices 115, 125, 135, a drawing device 160, texturizer 170, and final tacking device 180. Although not shown, the spin plates 112, 122, 132 and pumps 101, 102, 103 may be included in one or more spin stations.

Each spin plate 112, 122 and 132 may be, for example, a spinneret. Each spin plate defines a plurality of openings through which the molten polymer streams are spun. The radial cross-sectional shape of each opening defines at least in part the radial cross-sectional shape of each filament. At least a portion of the radial cross-sectional shapes of the openings in each spin plate may be the same or different.

In general, in relation to each of the inventive aspects, it is noted that each filament has a given radial cross-sectional shape, such as circular, oval, fox, trilobe-shaped, or other suitable radial cross-sectional shape. In some implementations, the radial cross-sectional shapes of the filaments in each bundle are the same, and in other implementations, the shapes of the filaments in each bundle may vary. And, the radial cross-sectional shapes of the filaments in one bundle may be the same or different from the radial cross-sectional shapes of the filaments in another bundle. For example, a bundle of filaments or the yarn may include filaments with different cross-sectional shapes to provide a desired texture. In addition, the filaments may be solid or define at least one hollow void. Similarly, the size of the spinneret openings may be the same or different, depending on the desired denier per filament for each filament.

Each pump 101, 102, 103 is in fluid communication with the respective extruder 110, 120, 130 for pushing the molten polymer from each extruder 110, 120, 130 through the respective spin plate 112, 122, 132. The processor 109 is in electrical communication with the spin pumps 101, 102, 103 and is configured to execute computer readable instructions that cause the processor to adjust a volumetric flow rate of the thermoplastic polymers pumped by each spin pump to achieve a ratio of the thermoplastic polymers to be included in the yarn. The volumetric flow rate can be varied such that the flow of the polymer streams through the spinnerets are continuous and support continuous filament formation. For example, in one implementation, the volumetric flow rate extruded by each of the spin pumps is greater than zero and is variable by ±40% or less of a baseline volumetric flow rate, wherein the baseline volumetric flow rate is equal to a total volumetric flow rate through the pumps divided by the number of pumps.

By increasing the denier per filament of filaments in one or more bundles of filaments of the yarn, the color from that group of filaments is visibly more prevalent in the yarn. If other process controls are the same, increasing the speed of the spin pump increases the volumetric flow rate of the molten thermoplastic polymer through the spinneret in fluid communication with the spin pump, and an increased volumetric flow rate through the spinneret increases the average denier per filament of the filaments spun through the spinneret. Conversely, decreasing the speed of the spin pump decreases the volumetric flow rate of the molten thermoplastic polymer through the spinneret in fluid communication with the spin pump, and a decreased volumetric flow rate through the spinneret reduces the average denier per filament of the filaments spun through the spinneret. Thus, the average denier per filament of the filaments in each filament bundle can be increased or decreased by changing the speed (and thus the volumetric flow rates) of the respective pump(s) in communication with the spinnerets through which the filaments in each bundle are spun. Increasing and decreasing the speed of at least one or more pumps can also be varied according to a certain frequency and amplitude, in some implementations, creating portions of a length of the bundle that have a higher DPF than other portions of the length.

Although not shown, the system 100 can be scaled to include another set of spin stations that are paired with each extruder (or one or more additional spin stations with pumps and spin plates paired with each extruder) for producing a second yarn with a second ratio of thermoplastic polymers to be included the second yarn. In such embodiments, a sum of the volumetric flow rates extruded from each extruder by the spin pumps paired with the respective extruder varies 0 to ±5%. Accordingly, the sum of the areas of radial cross-sections of all filaments in a radial cross-section of the yarn varies by ±5% or less. However, the average denier of the yarn from the first set of spin stations may be different from the average denier of the yarn from the second set of spin stations.

In other implementations, the volumetric flow rate displaced by each pump that is paired with a particular extruder is not limited relative to the volumetric flow rate displaced by the other pumps unless there is a desire to maintain a constant throughput of the extruder with which the pumps are paired.

Adjusting the volumetric flow rate of the thermoplastic polymer displaced by each of the extruders 110, 120, 130 by each spin pump 101, 102, 103 adjusts the ratio of the thermoplastic polymers in the yarn 190, which changes the overall color, hue, and/or dyability characteristic of the yarn. The ratio of the thermoplastic polymers to be included in the yarn 190 refers to the ratio of colors, hues, and/or dyability characteristics from each extruder 110, 120, 130 that are included in the yarn 190. The yarn 190 includes a first bundle of filaments 114 having the color, hue, and/or dyability characteristic of the polymer in the first extruder 110, a second bundle of filaments 124 having the color, hue, and/or dyability characteristic of the polymer in the second extruder 120, and a third bundle of filaments 134 having the color, hue, and/or dyability characteristic of the polymer in the third extruder 130. When the bundles of filaments 114, 124, 134 are brought together into the yarn 190, the bundles of filaments 114, 124, 134 in the yarn 190 provide a color and/or hue appearance that depends on the relative linear densities, or titer (e.g., also referred to as "denier per filament", "denier per fiber" or "DPF")) per filament, of each filament in each bundle 114, 124, 134.

Thus, the overall color, hue, and/or dyability characteristic of the yarn 190 can be altered by altering the relative denier per filament of the filaments from each extruder 110, 120, 130 along the length of the filaments. The desired denier per filament of the filaments in each filament bundle 114, 124, 134 depends on the volumetric flow rate through each pump 101, 102, 103. For example, if the desired overall color for the yarn 190 is the color of the polymer in extruder 110, then the processor 109 adjusts the volumetric flow rate of the pumps 101, 102 103 such that the denier per filament of the filaments in bundle 114 is larger than the denier per filament of the filaments in bundles 124, 134. This combination results in the appearance that the yarn 190 has the color of the polymer in extruder 110 because the filaments with the smaller denier are not as prominent. As another example, if the desired overall color for the yarn 190 is a mixture of the colors of the polymers in extruders 110, 120, then the processor 109 adjusts the volumetric flow rate of the pumps 101, 102, 103 such that the denier per filament of the filaments in bundles 114, 124 are larger than the denier per filament of the filaments in bundle 134. This combination results in the appearance that the yarn has a color that is a mixture of the colors of the polymers in extruder 110 and 120 because the filaments with the smaller denier are not as prominent. As a third example, if the desired overall color of the first yarn is an even mixture of the colors from all three extruders 110, 120, 130, then then the processor 109 adjusts the volumetric flow rate of the pumps 101, 102, 103 to the baseline volumetric flow rate such that the denier per filament of the filaments in bundles 114, 124, 134 are the substantially same.

This system 100 allows for filaments to be made having more colors and/or hues than the number of extruders providing each color or hue. For example, if the extruders 110, 120, 130 each have thermoplastic polymers solution dyed red, blue, and yellow, various ratios of these thermoplastic polymers yield filaments having these colors and combinations thereof, such as purple, orange, and green.

For example, in some implementations, the speed of each spin pump 101, 102, 103 is at least 2 RPM. And, in certain implementations, a maximum speed of each spin pump 101,102, 103 is 30 RPM. However, in other implementations, the maximum speed of each spin pump may be higher.

In some implementations, the instructions also cause the processor 109 to determine the volumetric flow rate of each thermoplastic polymer to be pumped by each spin pump 101, 102, 103 to achieve the desired ratio and generate the instructions to the spin pumps 101, 102, 103 based on the volumetric flow rate determinations. However, in other implementations, the volumetric flow rate for each spin pump 101, 102, 103 may be determined by another processor or otherwise input into the system 100. In addition, in other implementations, the instructions to the spin pumps 101, 102, 103 may be generated by another processor or otherwise input into the system 100.

The volumetric flow rate can be varied such that the flow of the polymer streams through the spinnerets are continuous and support continuous filament formation. For example, in one implementation, the volumetric flow rate extruded by each of the spin pumps is greater than zero and is variable by ±40% or less of the baseline volumetric flow rate, which is the total volumetric flow rate through the pumps divided by the number of pumps. The variation in the volumetric flow rate of the thermoplastic polymer may be based on, but is not limited to, the type of polymer, a size and/or shape of the capillaries of the spinneret, the temperature of the polymer, and the denier per filament of the filaments spun from that spinneret.

Figure 9:
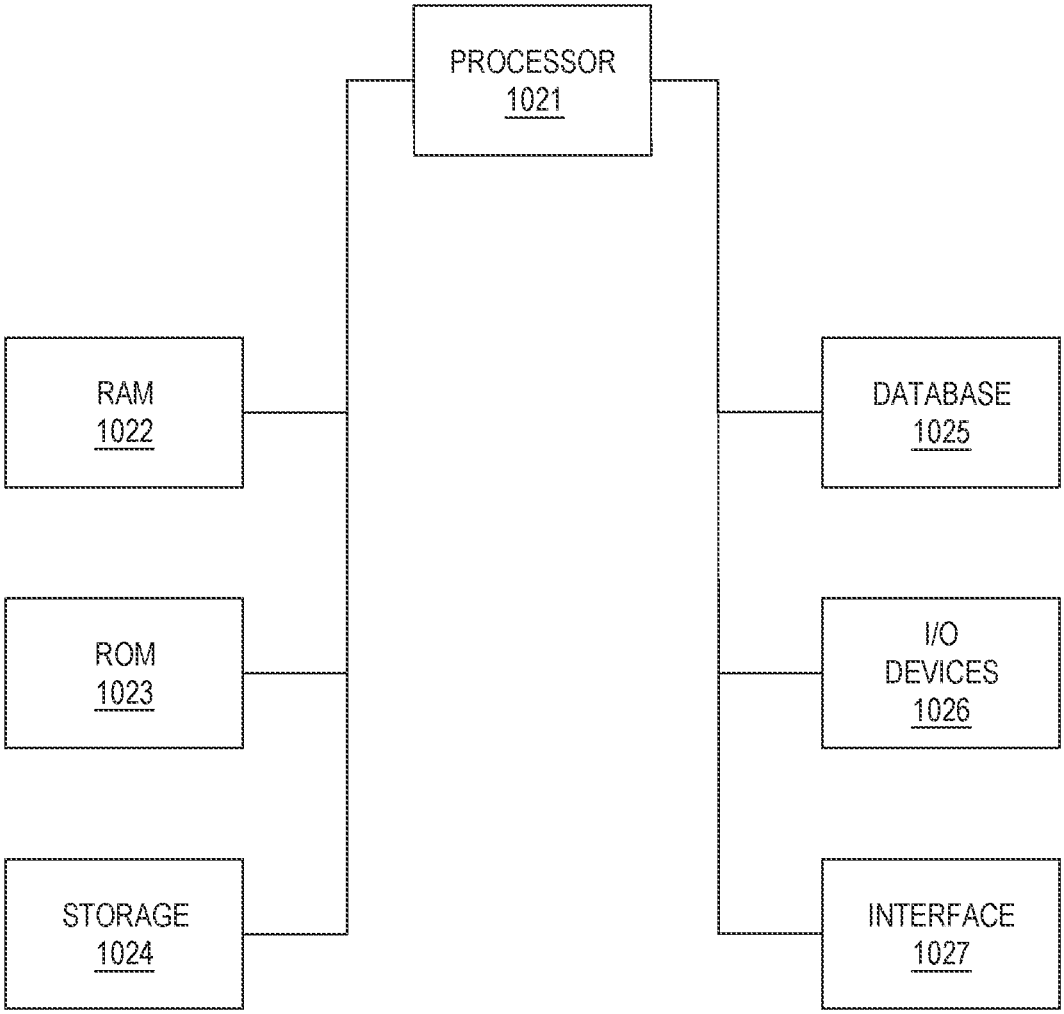
FIG. 9 illustrates an example computing device that can be used according to embodiments described herein.

In some implementations, the computer readable instructions are stored on a computer memory that is in electrical communication with the processor 109 and disposed near the processor (e.g., on the same circuit board and/or in the same housing). And, in other implementations, the computer readable instructions are stored on a computer memory that is in electrical communication with the processor but is remotely located from the processor. In some instances, the processor 109 and memory form a computer device such as that shown in FIG. 9, which is described below. FIG. 9 illustrates an example computing system that includes a processor, which can include processor 109. The system in FIG. 9 may be used by system 100, for example.

Referring back to FIG. 1, the initial tacking devices 115, 125 and 135 are air entanglers that use room temperature air for entangling the filaments. In other embodiments, the tacking devices include heated air entanglers (e.g., air temperature is higher than room temperature) or steam entanglers, for example. The tacking is done with air entangling every 6 to 155 mm (e.g., 20 to 50 mm). The tacking devices 115, 125, 135 may use 2 to 6 bar pressure, but the pressure may increase with an increased number of filaments, increased denier per filament, and/or increased speed of filament production.

The drawing device is at least one or more godets, for example, but in other implementations, it can also include draw point localizer.

The texturizer 170 applies air, steam, heat, mechanical force, or a combination of one of more of the above to the drawn filaments passing through it.

Final tacking device 180 may be similar to the tacking devices 115, 125, 135 described above or the alternative embodiments described in relation thereto.

To produce a BCF yarn using the system 100, three molten polymer streams 111, 121 and 131 with mutually different colors are provided to respective spin stations by the respective pumps. In other embodiments, at least one molten polymer stream may have a different color, hue, and/or dyability characteristic than the other streams. For example, the molten polymer streams may have mutually different colors, hues, and/or dyability characteristics.

Examples of thermoplastic polymers that may be used in each of the aspects include polyamides, polyesters, and polyolefins. For example, the polymer may be aromatic or aliphatic polyamide, such as PA6, PA66, PA6T, PA10, PA12, PA56, PA610, PA612, PA510. The polyamide can be a polyamide blend (copolymer) or homopolymer or partially recycled or fully based upon recycled polyamide.

In other implementations of each of the aspects, the polymer may be polyester, such as polyethylene terephthalate (PET), polybutyl terephthalate (PBT), or polytrimethylene terephthalate (PTT). The PET can be virgin PET or partially or fully based upon recycled PET, such as the PET described in U.S. Pat. No. 8,597,553.

In yet other implementations of each of the aspects, the polymer may be a polyolefin, such as polyethylene (PE) or polypropylene (PP). In certain implementations, the polymer is PET, PTT, PP, PA6, PA66 or PES.

In some implementations of each of the aspects, the bundles are made from the same polymer. However, in other implementations, bundles may be made from different polymers.

According to some implementations of each of the aspects, the polymer of the filaments may be solution dyed polymer. In other implementations, the filaments are space dyed or dyed regularly after processing.

Dyability characteristic refers to the ability of the polymer to absorb dye. For example, non-solution-dyed filaments may appear white after spinning due to the lack of presence of dye molecules, pigments, or other molecules that would provide a different color than the material substrate. When subjected to a dyeing process, for example PET using disperse dyes, a molten stream formed with a deep dye PET would have a darker color saturation than a molten stream produced with a traditional PET.

Three bundles of filaments 114, 124 and 134 are spun from each spin plate 112, 122, and 132, respectively, and are quenched by quenchers 150. Each bundle 114, 124, and 134 comprises an average of 8-120 filaments.

The number of bundles of filaments shown in FIG. 1 is three, but in other embodiments, there may be more than three bundles.

Each of these bundles 114, 124 and 134 of spun filaments are then tacked individually by respective tacking device 115, 125 and 135. In other words, each bundle 114, 124, 134 is physically separated from the other bundles and only the filaments belonging to the respective bundle are tacked together.

The bundles of tacked filaments 116, 126 and 136 are then drawn to the final titer over drawing device 160, which includes a plurality of godets. The godets are each turned at a different speed, according to some embodiments. The draw ratio is typically 1.5 to 4.5. Each filament is drawn to a titer of 2 to 40 titer (weight per length), which is also referred to as the denier per filament ("DPF"). Three bundles of elongated spun filaments 117, 127 and 137 are provided after drawing.

In alternative embodiments (not shown in FIG. 1), air entanglement can be applied to one or more of the bundles by turning off or on air to 115, 125, and/or 135. In addition, in other embodiments, air can be applied constantly or in an on/off sequence to get the desired end effect.

And, in yet another embodiment (not shown in FIG. 1), the bundles of spun filaments are first elongated partially before being tacked individually. After the tacking step, the spun, tacked bundles are further elongated to the final denier.

In some embodiments of each of the aspects, the DPF of the filaments in each of the bundles are equal. However, in other embodiments, at least some of the filaments in one bundle may have a different DPF than the other filaments in the bundle. Or, in some embodiments, the filaments in one bundle may have the same DPF as other filaments in the bundle but the DPF of those filaments may be different from the DPF of the filaments in another bundle. And, in some embodiments, the number of filaments in the bundles are equal. And, in other embodiments, the number of filaments in each bundle may differ. The denier per filament of the spun filaments in one or more of the bundles may be increased by increasing the speed of the respective pump providing the polymer stream to the spin station from which the filaments are extruded or decreased by decreasing the speed of the respective pump. By increasing the denier per filament of a bundle, the color from that bundle is visibly more prevalent in the yarn. For example, the speed of the pump providing the molten polymer stream to the spin station may be increased while the speed of the pumps providing the other molten polymer streams to the other spin stations may be kept the same or decreased, resulting in the yarn having more of the color of the stream being pumped at a higher speed than the other streams. And, increasing and decreasing the speed of at least one or more pumps can also be varied according to a certain frequency and amplitude, in some implementations, creating portions of a length of the bundle that have a higher DPF than other portions of the length.

After the drawing step, bundle 117 has a first color, bundle 127 has a second color while bundle 137 has a third color, wherein the first, second, and third colors are different. For example, the first color may be red, the second color blue, and the third color yellow. In other embodiments, the first, second, and third colors are different hues of the same color or a combination of different hues and/or colors.

The bundles 117, 127 and 137 are provided to the texturizer 170. The bundles 117, 127, 137 are texturized to have a bulk (or crimp or shrinkage) of 5-20%.

The texturized bundles of spun filaments 118, 128 and 138 are then guided to a tacking device 180. For example, if the tacking device 180 is an air entangler, the air entangler may use 2 bar to 6 bar pressure, but the pressure may increase with an increased number of filaments, increased denier per filament, and/or increased speed of filament production. The bundles 118, 128 and 138 are tacked and as such provide a BCF yarn 190 comprising an average of 24-360 filaments of 2 to 40 DPF each. The tacking is done with air entangling every 12 to 80 mm. The tacking may be done more frequently for a specific look desired. For example, with more frequent tacking, the yarn looks less bulky and the color separation is reduced, which results in a more blended look for the colors.

When looking along the axial length of the yarn 190, the position of the filaments originating from bundles 114, 124 and 134 are more pronounced in the yarn 190 than if the bundles of filaments 114, 124, 134 had not been individually tacked with tacking devices 115, 125, and 135.

Individually tacking each bundle of filaments 114, 124, 134 prevents each tacked bundle of filaments from intermingling with the other bundles of filaments during further drawing, texturizing, and tacking. As such, in case each bundle comprises color-identical filaments and the color of the filaments differ between the bundles, each individually tacked bundle of filaments provides a more pronounced group of filaments in the final BCF yarn, causing the color of each individually tacked bundle to be more pronounced. In case more than one bundle, such as all bundles, is individually tacked during and/or prior to elongation, the colors of all the individually tacked bundles are more pronounced in the final BCF yarn.

Figure 2:
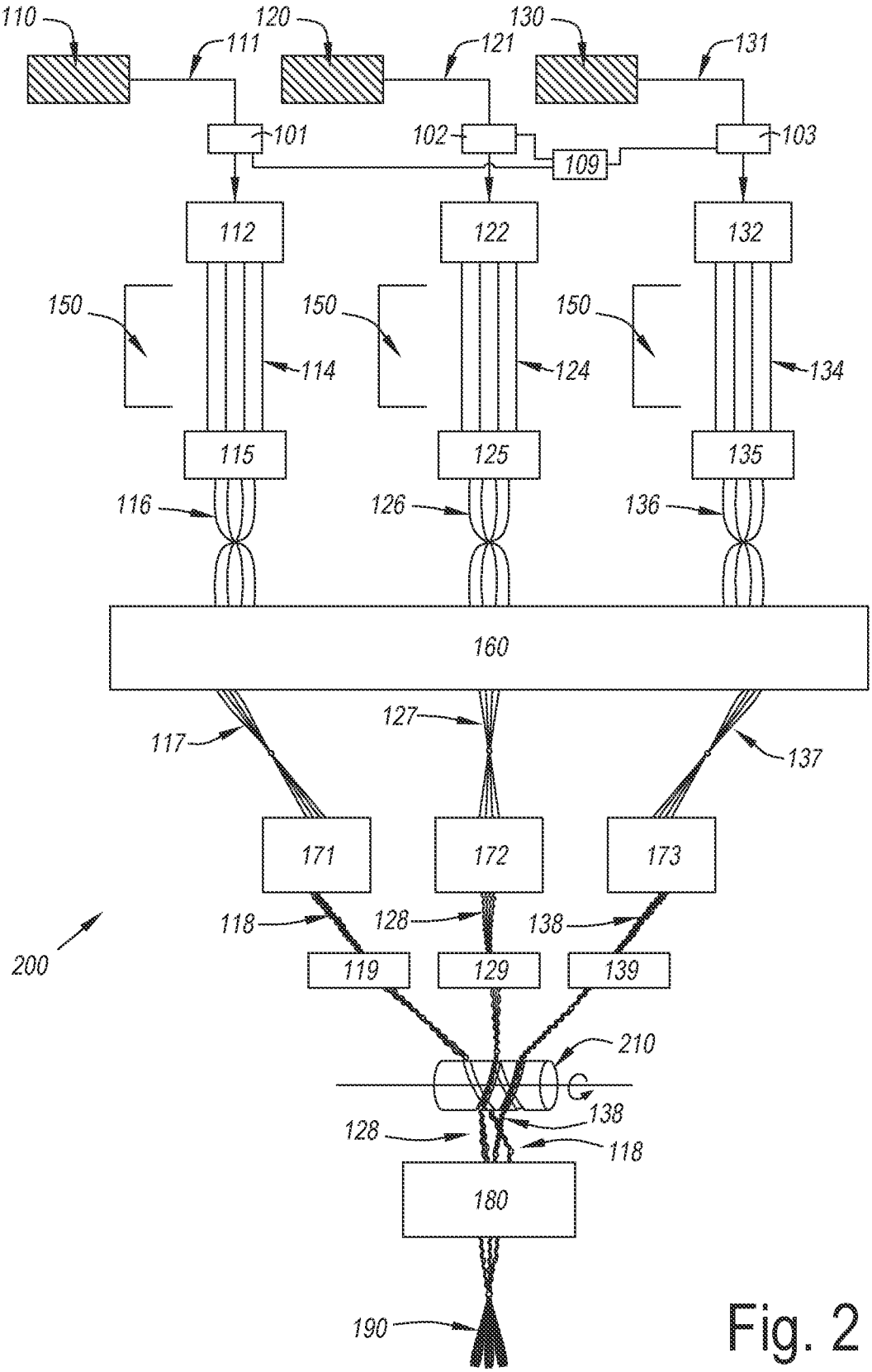
FIG. 2 illustrates a schematic diagram of a system according to second implementation.
Figure 3:
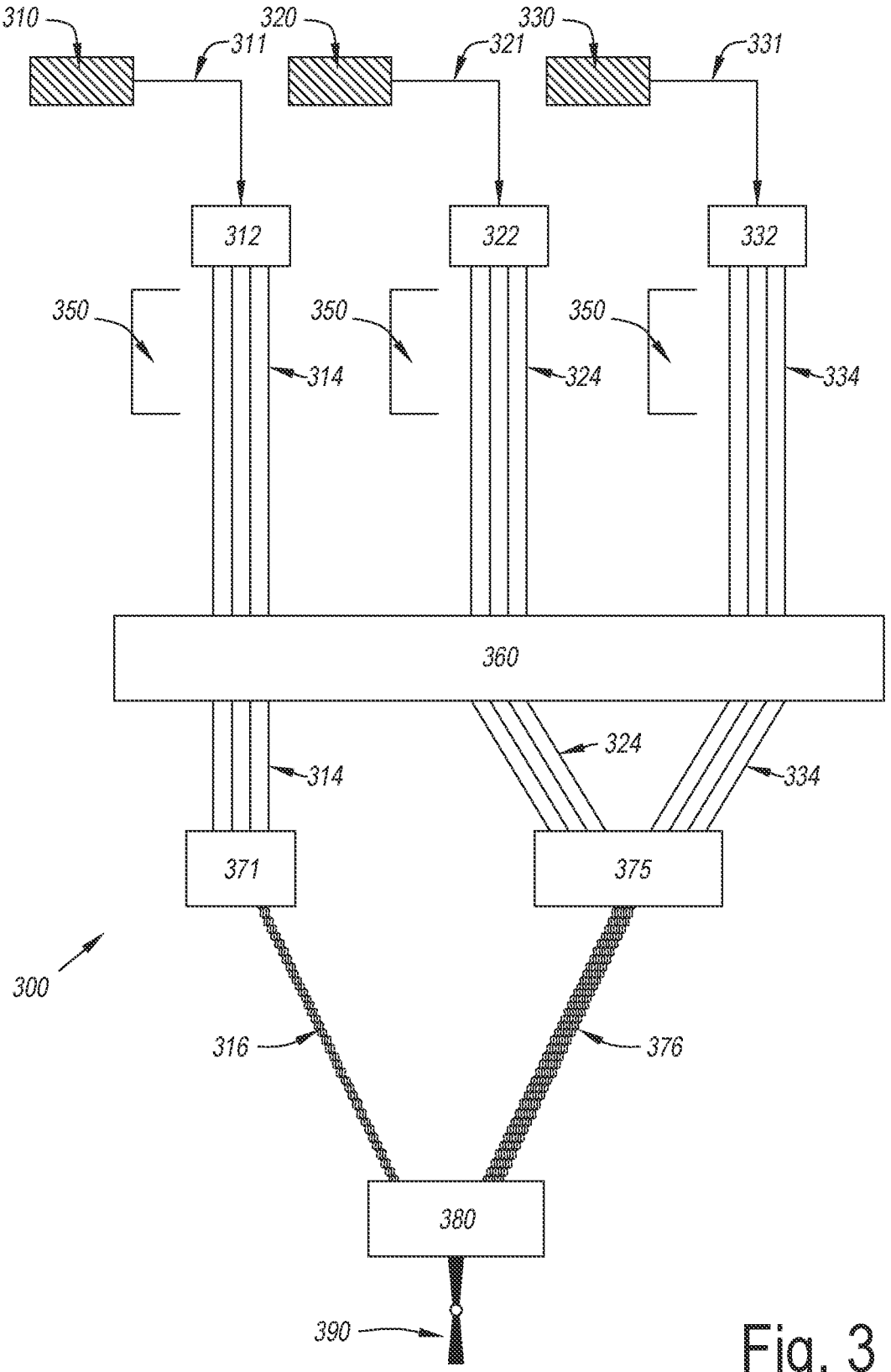
FIG. 3 illustrates a schematic diagram of a system according to third implementation.

In FIG. 2, an alternative system and method are shown for providing a BCF yarn 190. The system 200 is similar to system 100 through the drawing step via drawing device 160, but the system 200 in FIG. 2 provides for two additional color enhancement processes for the tacked and drawn filaments 117, 127, and 137. In particular, instead of texturing these filaments 117, 127, 137 together in texturizer 170, each tacked and drawn bundle of filaments 117, 127, 137 are texturized separately through texturizers 171, 172, 173, respectively. Following this, bundles 118, 128 and 138 of texturized filaments are provided. The texturizer devices 171, 172 and 173 are similar to the texturizer device 170 described above or the alternative embodiments described related thereto, and the bundles are texturized to have a bulk of 5-20%.

Texturizing individual bundles of filaments separately, when using bundles with different colors and/or shades of one color amongst each other, provides a more pronounced color or shade of a color along the axial length of the BCF yarn. The filaments that are texturized separately tend to stay more grouped together during the rest of the production steps to make the BCF yarn, which results in the color or the shade of color of this bundle of spun filaments being more pronounced along the length of the BCF yarn.

The separate texturizing of one or more bundles of the spun filaments cause the separately texturized bundle to be more pronounced in the final yarn. When this bundle has a color different from the other bundles, or even better if all bundles have a mutually different color, the color of the separately texturized bundles is more pronounced in the final BCF yarn.

In addition to texturizing the tacked and drawn filaments 117, 127, 137 separately, the filaments 117, 127, 137 are subjected to an individual color entanglement process prior to the final tacking at tacking device 180. In this individual color entanglement process, the bundles 118, 128 and 138 of texturized filaments are fed into separate tacking devices 119, 129 and 139 to tack individually each bundle of texturized spun filaments. The tacking devices 119, 129, 139 are similar to the tacking devices 115, 125, 135, and 180 described with respect to FIG. 1. For example, if the tacking devices 119, 129, 139 are air entanglers, the air entanglers may entangle every 15 to 155 mm and may use 2 bar to 6 bar pressure, but the pressure may increase with an increased number of filaments, increased denier per filament, and/or increased speed of filament production. The separate tacking devices 119, 129, 139 are disposed between the separate texturizers 171, 172, 173 and the final tacking device 180. The tacking may be done more frequently for a specific look desired. For example, with more frequent tacking, the yarn looks less bulky and the color separation is reduced, which results in a more blended look for the colors.

After being individually tacked with tacking devices 119, 129, and 139, the bundles 118, 128 and 138, are guided to a mixing cam 210, which is disposed between the tacking devices 119, 129, 139 and final tacking device 180. The mixing cam 210 positions bundles tacked by tacking devices 119, 129, 139 relative to each other prior to being tacked together in final tacking device 180. The mixing cam 210 is cylindrical and has an external surface defining a plurality of grooves for receiving and guiding the texturized and tacked bundles.

The mixing cam 210 is rotatable about its central axis or can be stationary. If rotated, the mixing cam 210 varies which side of the bundles are presented to the tacking jet in the tacking device 180, which affects how the bundles (and filaments therein) are layered relative to each other. In some embodiments, the positions are randomly varied. The speed of rotation can be changed to provide a different appearance in the yarn 190. For example, one or more of the bundles 118, 128, 138 may have a first color on one side of the bundle 118, 128, 138 and a second color on another side of the bundle 118, 128, 138, wherein the sides of the bundle are circumferentially spaced apart but intersected by the same radial plane. It may be desired to have the first color on an exterior facing surface of an arc in a carpet loop in one area of the carpet and the second color on an exterior facing surface of an arc in a carpet loop in another area of the carpet. Rotating the cam 210 may "flip" one or more of the bundles 118, 128, 138 such that the desired color is oriented on a portion of the outer surface of the yarn 190 such that the desired color is on the exterior facing surface of the arc in the carpet loop. The undesired color for that portion of the carpet is hidden on the inside facing surface of the loop. Rotation of the cam 210 ensures that the filaments that run on the outside of the loop are changing due to a specific mechanical means and not necessarily natural occurrences in downstream processes.

When stationary, the positions of the bundles 118, 128, 138 are directed by the mixing cam 210 but their relative positions are not varied. In alternative embodiments, the bundles 118, 128, 138 are fed to the tacking device 180 directly or they are fed via a stationary guide disposed between the intermediate tacking devices 119, 129, 139 and the tacking device 180.

The tacked texturized bundles 118, 128 and 138 positioned by mixing cam 210 are thereafter tacked together by tacking device 180 into a BCF yarn 190. This tacking is done with air entangling every 12 to 80 mm. The tacking may be done more frequently for a specific look desired. For example, with more frequent tacking, the yarn looks less bulky and the color separation is reduced, which results in a more blended look for the colors.

The effect of this individual tacking and guidance via a mixing cam cause the colors in the yarn to be more structured and positioned. When such yarn is used as for example, a tufting yarn in a tufted carpet, the positioning of the colored bundles in the yarn cause bundles to be more pronounced in the final carpet surface. The positioning of the color in the BCF yarn has as effect that this color can be locally more present on the top side of the tuft oriented upwards, away from the backing of the carpet, or hidden at the low side of the tuft oriented towards the backing of the carpet. The effect is the provision of very vivid and pronounced color zones on the carpet.

In other embodiments, one or more of the bundles of spun filaments may be elongated without tacking prior to being drawn, such as is shown in FIGS. 3-8. And, in some other embodiments (not shown), two or more bundles may be tacked together prior to being drawn.

Another embodiment of a system for producing BCF yarn is shown schematically in FIG.

3. The system 300 includes three extruders 310, 320 and 330, three spin stations, 312, 322, 332, quenchers 350, a drawing device 360, two texturizers 371, 375, and a final tacking device 380. Each spin station 312, 322, 332 is similar to the spin stations 112, 122, 132 and quenchers 350 are similar to quenchers 150 described above in relation to FIG. 1. The drawing device 360 is similar to the drawing device 160 described above in relation to FIG. 1 or the alternative embodiments described related thereto. The texturizers 371, 375 are similar to the texturizer 170 described above in relation to FIG. 1 or the alternative embodiments described related thereto. And, the final tacking device 380 is similar to the final tacking device 180 described above in relation to FIG. 1 or the alternative embodiments described related thereto.

Each spin station 312, 322, 332 includes a pump and a spin plate through which respective molten polymer streams 311, 321, 331 are pumped from respective extruders 310, 320, 330. In this embodiment, the molten polymer streams 311, 321 and 331 have mutually different colors. However, as noted with respect to FIG. 1, the molten polymer streams may have one or more different colors, hues, and/or dyability characteristics. Although not shown, the system 300 may also include a processor in electrical communication with each pump, as is shown and described above in relation to FIG. 1.

Three bundles of filaments 314, 324 and 334 are spun from each spin station 312, 322, 332, respectively, quenched by quenchers 350, and drawn to the final titer by the drawing device 360, which is a plurality of godets. Each bundle comprises an average of 8-120 filaments having, after drawing, a titer of 2 to 40 titer per filament (or denier per filament (DPF)).

In an embodiment, spun filaments are melt spun filaments. The polymers used to make each a bundle of spun filaments may be polyesters (PES) like polyethylene terephthalate (PET), polytrimethyl terephthalate (PTT), polybutyl terephthalate (PBT), polyamides (PA) such as PA6, PA6.6, PA6.10, PA6T, PA10, polyolefin (such as polypropylene (PP) or polyethylene (PE), or any combination of those. In some implementations, the bundles are made from the same polymer. However, in other implementations, bundles may be made from different polymers.

After the drawing, bundle 314 has a first color, bundle 324 has a second color while bundle 334 as a third color. Bundles 324 and 334 can also have the same color. Bundle 314 has a color that is different than bundles 324 and 334. For example, the first color may be red, the second color blue, and the third color yellow. In other embodiments, the first, second, and third colors are different hues of the same color or a combination of different hues and/or colors.

As noted above, in other embodiments, at least one molten polymer stream may have a different color, hue, and/or dyability characteristic than the other streams. For example, the molten polymer streams may have mutually different colors, hues, and/or dyability characteristics. Dyability characteristics refer to a filaments affinity to absorb a dye. In addition, according to some implementations, the polymer(s) of the filaments may be solution dyed polymer(s). In other implementations, the filaments are space dyed or dyed regularly after processing.

The first bundle 314 is provided to texturizer 371 and is texturized to have a bulk of 5-20%. This first bundle 314 is texturized separately from the other bundles 324, 334. The second and third bundles 324 and 334 are provided to texturizer 375 and are texturized jointly to have a bulk of 5-20%.

The two texturized bundles 316 and 376 are guided to tacking device 380. For example, if the tacking device 380 is an air entangler, the air entangler may use 2 bar to 6 bar pressure, but the pressure may increase with an increased number of filaments, increased denier per filament, and/or increased speed of filament production. The bundles 316 and 376 are tacked and as such provide a BCF yarn 390 comprising 24-360 filaments of 2 to 40 DPF. The tacking is done with air entangling every 12 to 80 mm. The tacking may be done more frequently for a specific look desired. For example, with more frequent tacking, the yarn looks less bulky and the color separation is reduced, which results in a more blended look for the colors.

When looking along the axial length of the yarn 390, the position of the filaments originating from bundle 314 are more pronounced as compared to the filaments originating from bundles 324 and 334. The latter are blend more intimately and the sole colors of the polymer streams 321 and 331 appears to have been merged, or blended.

Figure 4:
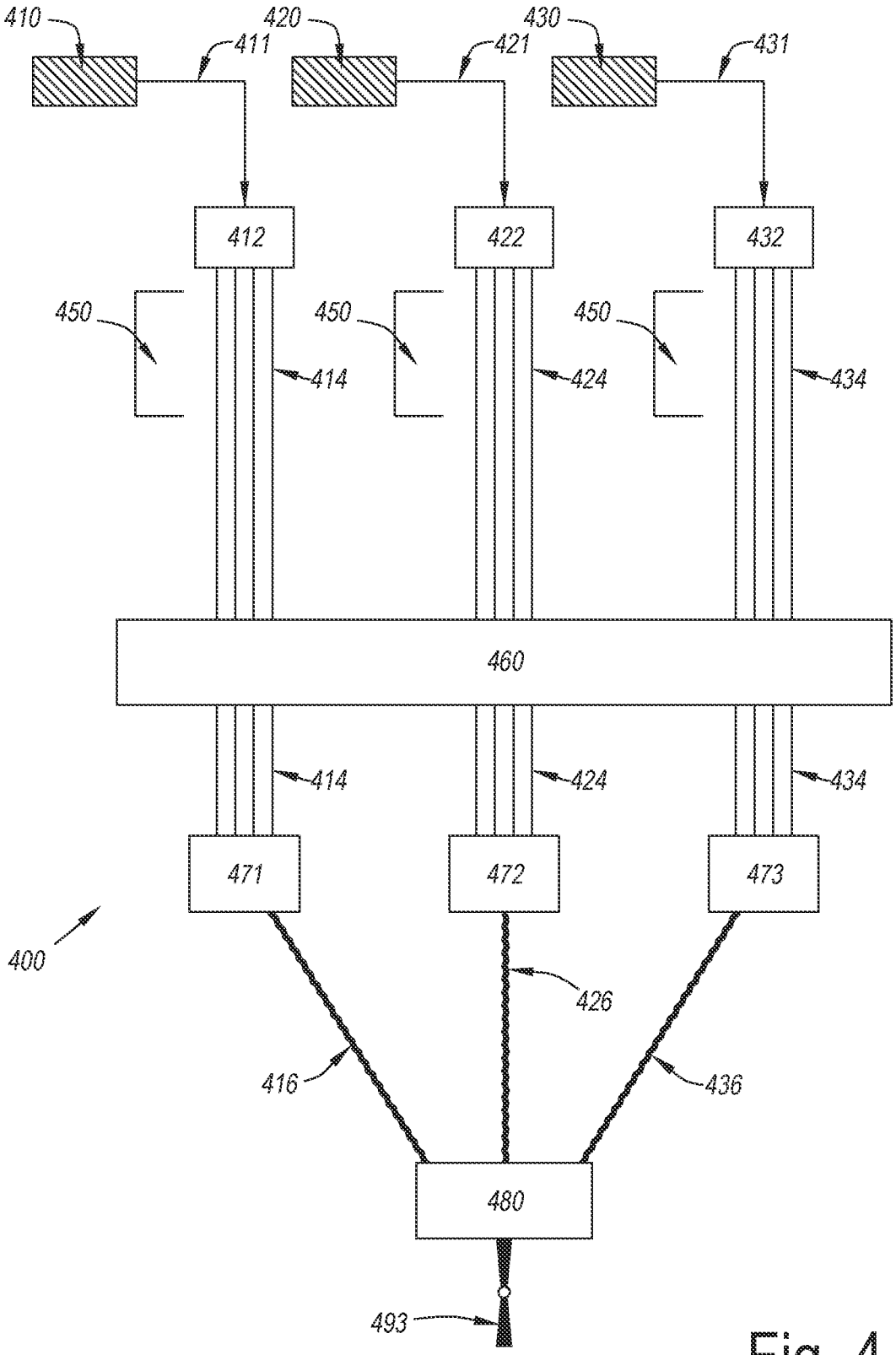
FIG. 4 illustrates a schematic diagram of a system according to fourth implementation.

FIG. 4 illustrates a schematic of another embodiment of a system 400 for producing BCF yarn. The system 400 includes three extruders 410, 420 and 430, three spin stations 412, 422, 432, quenchers 450, a drawing device 460, three texturizers 471, 472, 473, and a final tacking device 480. Each spin station 412, 422, 432 is similar to the spin stations 112, 122, 132 and quenchers 450 are similar to quenchers 150 described above in relation to FIG. 1. The drawing device 460 is similar to the drawing device 160 described above in relation to FIG. 1 or the alternative embodiments described related thereto. The texturizers 471, 472, 473 are similar to the texturizer 170 described above in relation to FIG. 1 or the alternative embodiments described related thereto. And, the final tacking device 480 is similar to the final tacking device 180 described above in relation to FIG. 1 or the alternative embodiments described related thereto.

Each spin station 412, 422, 432 includes a pump and a spin plate through which respective molten polymer streams 411, 421, 431 are pumped from respective extruders 410, 420, 430. Although not shown, the system 400 may also include a processor in electrical communication with each pump, as is shown and described above in relation to FIG. 1. In this embodiment, the molten polymer streams 411, 421 and 431 have mutually different colors. However, as noted with respect to FIG. 1, the molten polymer streams may have one or more different colors, hues, and/or dyability characteristics.

Three bundles 414, 424 and 434 are spun from the spin stations 412, 422, 432, quenched by quenchers 450 and drawn to the final titer by drawing device 460, which is a plurality of godets. Each bundle 414, 424, and 434 comprises an average of 8-120 filaments. And, after drawing, each filament in each bundle has a titer of 2 to 40 titer per filament (or denier per filament (DPF)).

In an embodiment, spun filaments are melt spun filaments. The polymers used to make each a bundle of spun filaments may be polyesters (PES) like polyethylene terephthalate (PET), polytrimethyl terephthalate (PTT), polybutyl terephthalate (PBT), polyamides (PA) such as PA6, PA6.6, PA6.10, PA6T, PA10, polyolefin (such as polypropylene (PP) or polyethylene (PE), or any combination of those. In some implementations, the bundles are made from the same polymer. However, in other implementations, bundles may be made from different polymers.

After the drawing step, bundle 414 has a first color, bundle 424 has a second color while bundle 434 has a third color, wherein the first, second, and third colors are different. For example, the first color may be red, the second color blue, and the third color yellow. In other embodiments, the first, second, and third colors are different hues of the same color or a combination of different hues and/or colors.

As noted above, in other embodiments, at least one molten polymer stream may have a different color, hue, and/or dyability characteristic than the other streams. For example, the molten polymer streams may have mutually different colors, hues, and/or dyability characteristics. Dyability characteristics refer to a filaments affinity to absorb a dye. In addition, according to some implementations, the polymer(s) of the filaments may be solution dyed polymer(s). In other implementations, the filaments are space dyed or dyed regularly after processing.

The first bundle 414 is provided to a texturizer 471 and is texturized to bulk 5-20%. This first bundle 414 is texturized separately from the other bundles 424,434. The second bundle 424 is provided to a texturizer 472 and is texturized to bulk 5-20%. The third bundle 434 is provided to a texturizer 473 and is texturized to bulk 5-20%. Thus, all bundles are texturized separately.

The three texturized bundles 416, 426 and 436 are then guided to tacking device 480. For example, if the tacking device 480 is an air entangler, the air entangler may use 2 bar to 6 bar pressure, but the pressure may increase with an increased number of filaments, increased denier per filament, and/or increased speed of filament production. The bundles are tacked and as such provide a BCF yarn 493 comprising 24-360 filaments of 2 to 40 DPF. The tacking is done with air entangling every 12 to 80 mm. The tacking may be done more frequently for a specific look desired. For example, with more frequent tacking, the yarn looks less bulky and the color separation is reduced, which results in a more blended look for the colors.

When looking along the axial length of the yarn 493, the position of the filaments originating from bundle 414, 424 and 434 are quite pronounced, depending on the position of the bundles within the yarn 493.

Figure 5:
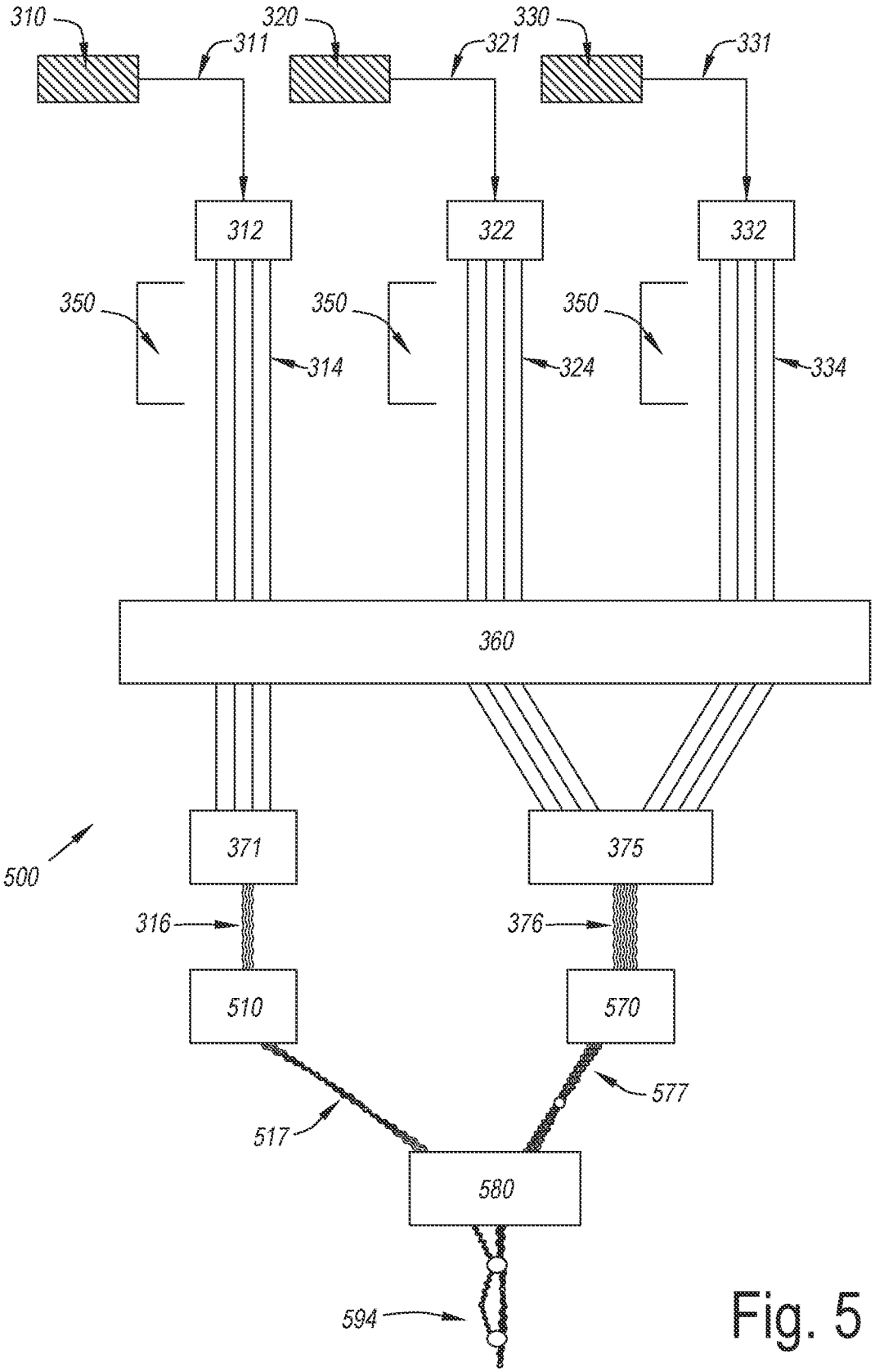
FIG. 5 illustrates a schematic diagram of a system according to fifth implementation.

An alternative system 500 is shown in FIG. 5. This system 500 is similar to the system 300 shown in FIG. 3 except that in the system 500 of FIG. 5, the drawn and texturized filaments 316 and 376 are provided to individual tacking devices 510, 570, respectively. The tacking is done with air entangling every 25 to 155 mm. The tacked texturized bundles 517 and 577—which may be understood as two intermediate single yarns—are thereafter tacked together by tacking device 580 into a BCF yarn 594. This tacking is done with air entangling every 12 to 80 mm. The tacking may be done more frequently for a specific look desired. For example, with more frequent tacking, the yarn looks less bulky and the color separation is reduced, which results in a more blended look for the colors. Tacking devices 510, 570, and 580 may be similar to the tacking devices 115, 125, 135 described above with respect to FIG.1 or the alternative embodiments described related thereto. For example, if the tacking devices 510, 570, and 580 are air entanglers, the air entanglers may use 2 bar to 6 bar pressure, but the pressure may increase with an increased number of filaments, increased denier per filament, and/or increased speed of filament production.

Figure 6:
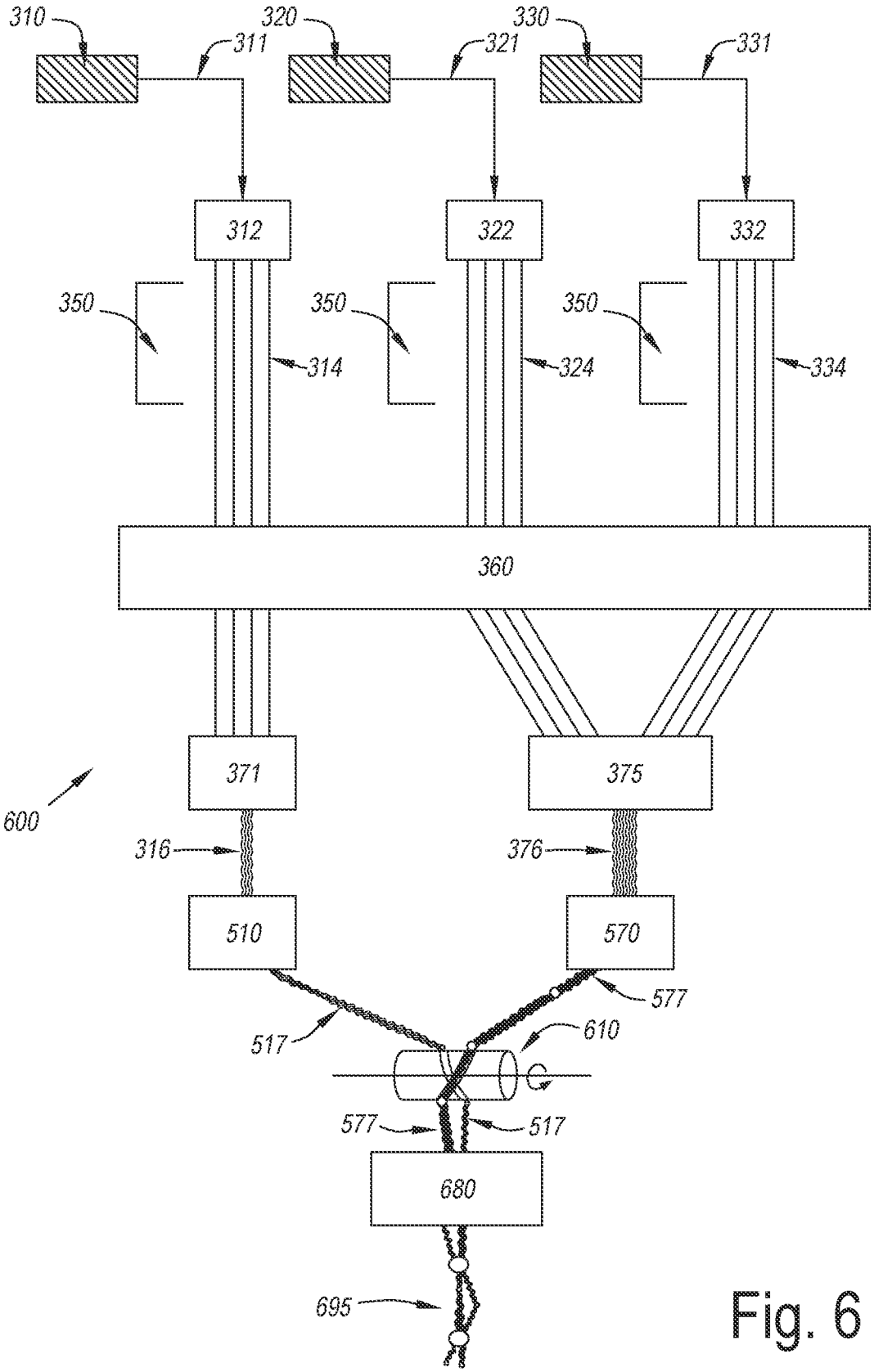
FIG. 6 illustrates a schematic diagram of a system according to sixth implementation.

Another alternative system 600 is shown in FIG. 6. System 600 in FIG. 6 is similar to the system 500 in FIG. 5 except that in the system 600 of FIG. 6, the drawn, texturized, and tacked filaments 517, 577 are guided to a mixing cam 610, which is similar to the mixing cam 210 described above in FIG. 2 or the alternative embodiments described related thereto. The mixing cam 610 positions bundles tacked by tacking devices 510, 570 relative to each other prior to being tacked together in final tacking device 680. The mixing cam 610 is cylindrical and has an external surface defining a plurality of grooves for receiving and guiding the texturized and tacked bundles.

The mixing cam 610 is rotatable about its central axis or can be held stationary. If rotated, the mixing cam 610 varies which side of the bundles are presented to the tacking jet in the tacking device 680, which affects how the bundles (and filaments therein) are layered relative to each other. In some embodiments, the positions are randomly varied. The speed of rotation can be changed to provide a different appearance in the yarn 695. For example, one or more of the bundles 517, 577 may have a first color on one side of the bundle 517, 577 and a second color on another side of the bundle 517, 577, wherein the sides of the bundle are circumferentially spaced apart but intersected by the same radial plane. It may be desired to have the first color on an exterior facing surface of an arc in a carpet loop in one area of the carpet and the second color on an exterior facing surface of an arc in a carpet loop in another area of the carpet. Rotating the cam 610 may "flip" one or more of the bundles 517, 577 such that the desired color is oriented on a portion of the outer surface of the yarn 695 such that the desired color is on the exterior facing surface of the arc in the carpet loop. The undesired color for that portion of the carpet is hidden on the inside facing surface of the loop. Rotation of the cam 610 ensures that the filaments that run on the outside of the loop are changing due to a specific mechanical means and not necessarily natural occurrences in downstream processes.

When stationary, the positions of the two bundles 517 and 577 are fed through the mixing cam 610 but their relative positions are not varied. The tacked texturized bundles 517, 577 positioned by cam 610 are thereafter tacked together by tacking device 680 into a BCF yarn 695. Tacking device 680 tacks the bundles 517, 577 using air entangling every 12 to 80 mm. In alternative embodiments, the bundles 517, 577 are fed to the tacking device 680 directly or they are fed via a stationary guide disposed between the intermediate tacking devices 510, 570 and the final tacking device 680.

Tacking device 680 may be similar to the tacking devices 115, 125, 135 described above with respect to FIG.1 or the alternative embodiments described related thereto. For example, if the tacking device 680 is an air entangler, the air entangler may use 2 bar to 6 bar pressure, but the pressure may increase with an increased number of filaments, increased denier per filament, and/or increased speed of filament production.

Figure 7:
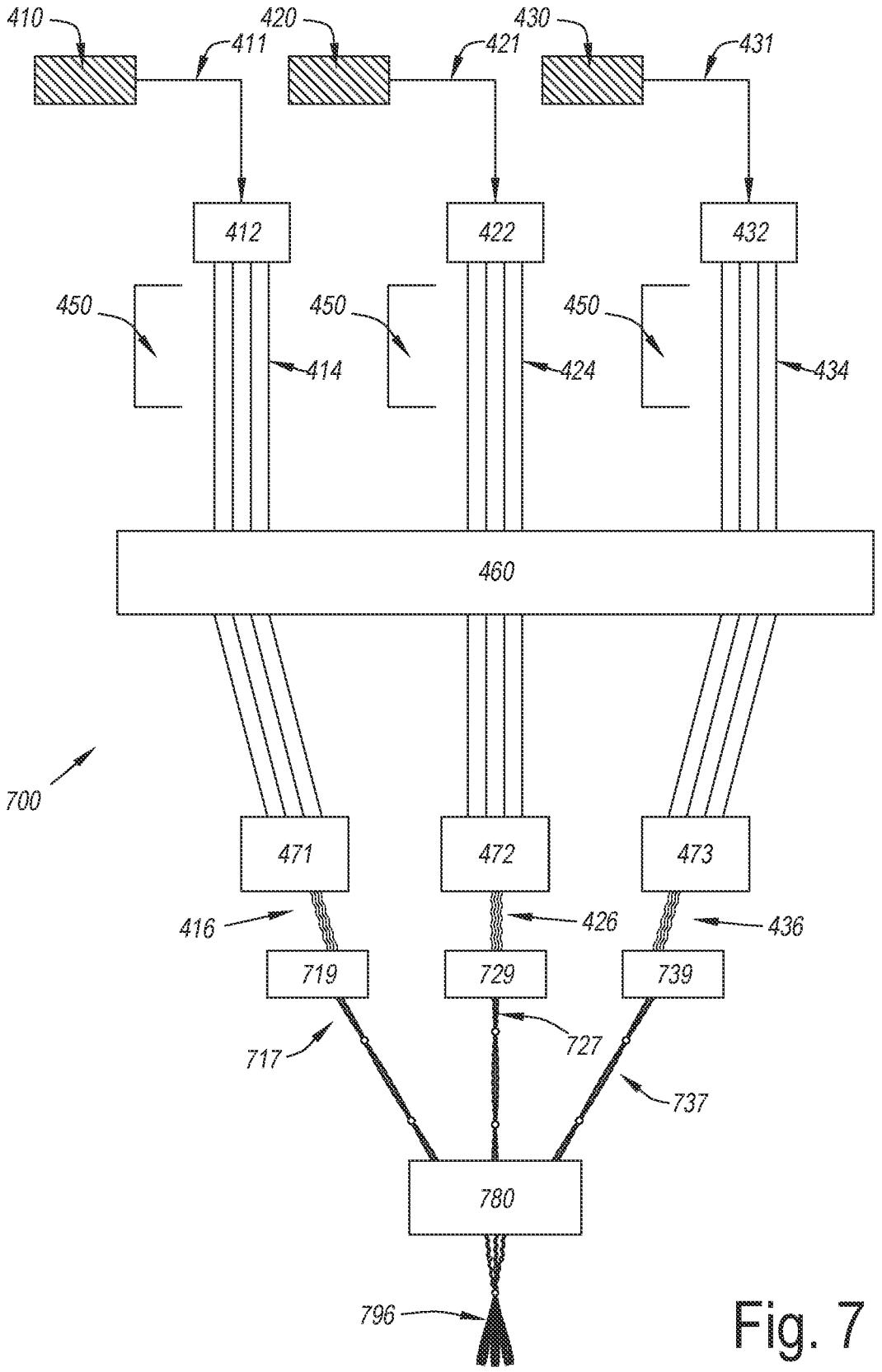
FIG. 7 illustrates a schematic diagram of a system according to seventh implementation.

Another alternative system 700 is shown in FIG. 7. The system 700 in FIG. 7 is similar to the system 400 in FIG. 4 except that in the system 700 of FIG. 7, the texturized bundles 416, 426, 436 are individually tacked by tacking devices 719, 729, 739, respectively. The tacking is done with air entangling every 25 to 155 mm. The tacked texturized bundles 717, 727, 737 are then fed to tacking device 780, and a BCF yarn 796 is produced. The tacking by tacking device 780 is done with air entangling every 12 to 80 mm. The tacking may be done more frequently for a specific look desired. For example, with more frequent tacking, the yarn looks less bulky and the color separation is reduced, which results in a more blended look for the colors. Tacking devices 719, 729, 739, and 780 may be similar to the tacking devices 115, 125, 135 described above with respect to FIG.1 or the alternative embodiments described related thereto. For example, if the tacking device 719, 729, 739, and 780 are an air entanglers, the air entanglers may use 2 bar to 6 bar pressure, but the pressure may increase with an increased number of filaments, increased denier per filament, and/or increased speed of filament production.

Figure 8:
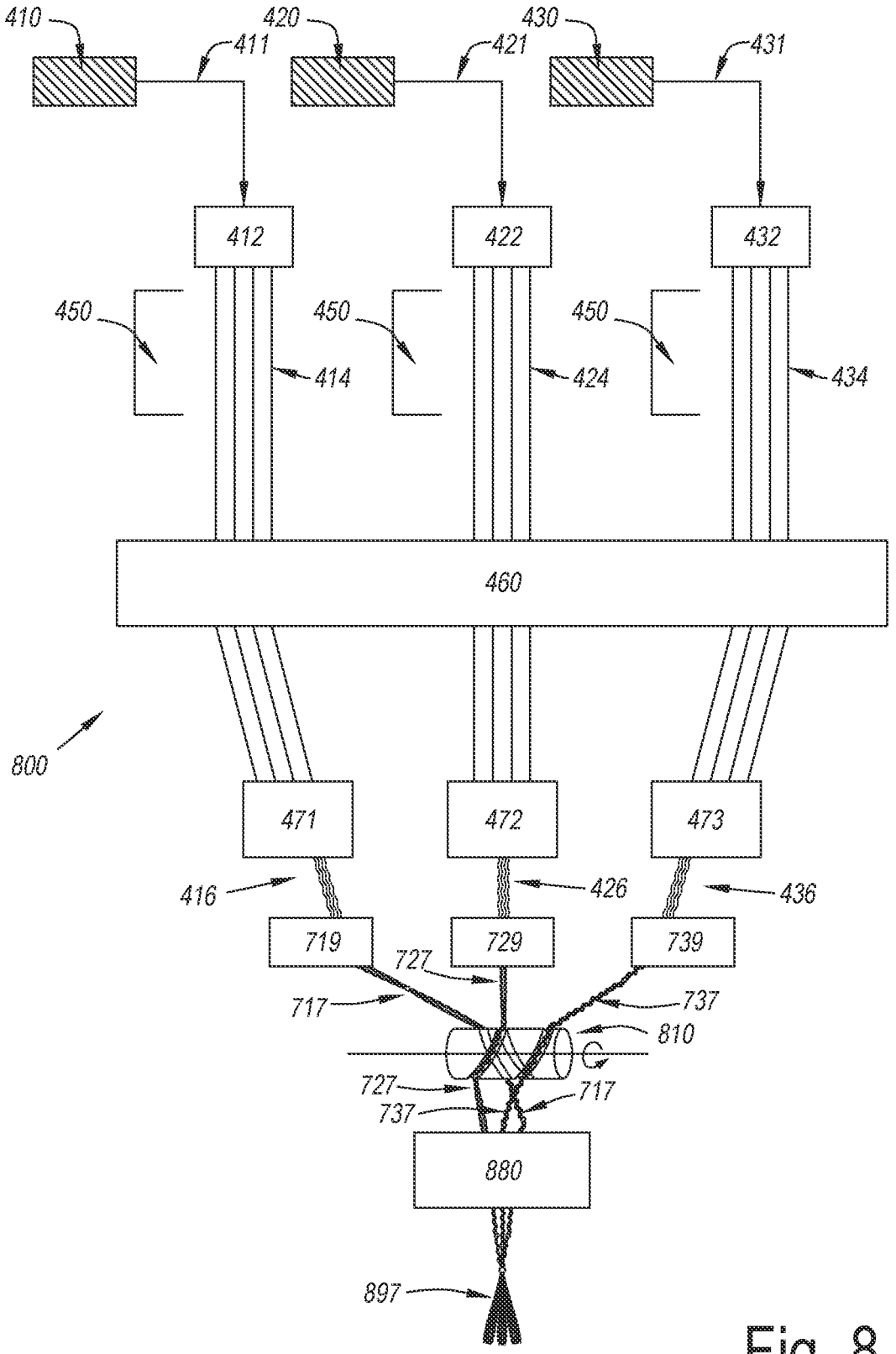
FIG. 8 illustrates a schematic diagram of a system according to eighth implementation.

Another alternative system 800 is shown in FIG. 8. The system 800 in FIG. 8 is similar to the system 700 in FIG. 7 except that the bundles 717, 727, 737 are guided to a mixing cam 810, which is similar to the mixing cam 210 described above in relation to FIG. 2 or the alternative embodiments described related thereto. The mixing cam 810 positions bundles 717, 727, 737 tacked by tacking devices 719, 729, 739 relative to each other prior to being tacked together in final tacking device 880. The mixing cam 810 is cylindrical and has an external surface defining a plurality of grooves for receiving and guiding the texturized and tacked bundles.

The mixing cam 810 is rotatable about its central axis or can be held stationary. If rotated, the mixing cam 810 varies which side of the bundles 717, 727, 737 are presented to the tacking jet in the tacking device 880, which affects how the bundles (and filaments therein) are layered relative to each other. In some embodiments, the positions are randomly varied. The speed of rotation can be changed to provide a different appearance in the yarn 897. For example, one or more of the bundles 717, 727, 737 may have a first color on one side of the bundle 717, 727, 737 and a second color on another side of the bundle 717, 727, 737, wherein the sides of the bundle are circumferentially spaced apart but intersected by the same radial plane. It may be desired to have the first color on an exterior facing surface of an arc in a carpet loop in one area of the carpet and the second color on an exterior facing surface of an arc in a carpet loop in another area of the carpet. Rotating the cam 810 may "flip" one or more of the bundles 717, 727, 737 such that the desired color is oriented on a portion of the outer surface of the yarn 897 such that the desired color is on the exterior facing surface of the arc in the carpet loop. The undesired color for that portion of the carpet is hidden on the inside facing surface of the loop. Rotation of the cam 810 ensures that the filaments that run on the outside of the loop are changing due to a specific mechanical means and not necessarily natural occurrences in downstream processes.

When stationary, the positions of the bundles 717, 727, 737 are fed through the mixing cam 810 but their relative positions are not varied. The tacked texturized bundles 717, 727, 737 positioned by cam 810 are thereafter tacked together by tacking device 880 into a BCF yarn 897. Tacking device 880 tacks the bundles 717, 727, 737 using air entangling every 12 to 80 mm. The tacking may be done more frequently for a specific look desired. For example, with more frequent tacking, the yarn looks less bulky and the color separation is reduced, which results in a more blended look for the colors. In alternative embodiments, the bundles 717, 727, 737 are fed to the tacking device 680 directly or they are fed via a stationary guide disposed between the intermediate tacking devices 719, 729, 739 and the final tacking device 880.

Tacking device 880 may be similar to the tacking devices 115, 125, 135 described above with respect to FIG.1 or the alternative embodiments described related thereto. For example, if the tacking device 880 is an air entangler, the air entangler may use 2 bar to 6 bar pressure, but the pressure may increase with an increased number of filaments, increased denier per filament, and/or increased speed of filament production.

There is a need to provide yarns, in particular BCF yarn, which have more pronounced variations of colors or shades of a color along its axial length. Such yarns, when used to provide the tufted surface of a tufted carpet, provide a colorful aspect to the tufted surface with very locally varying colors.

FIG. 9 illustrates an example computing device that can be used for controlling the pumps of the system 100. As used herein, "computing device" or "computer" may include a plurality of computers. The computers may include one or more hardware components such as, for example, a processor 1021, a random access memory (RAM) module 1022, a read-only memory (ROM) module 1023, a storage 1024, a database 1025, one or more input/output (I/O) devices 1026, and an interface 1027. All of the hardware components listed above may not be necessary to practice the methods described herein. Alternatively and/or additionally, the computer may include one or more software components such as, for example, a computer-readable medium including computer executable instructions for performing a method associated with the example embodiments. It is contemplated that one or more of the hardware components listed above may be implemented using software. For example, storage 1024 may include a software partition associated with one or more other hardware components. It is understood that the components listed above are examples only and not intended to be limiting.

Processor 1021 may include one or more processors, each configured to execute instructions and process data to perform one or more functions associated with a computer for producing at least one bundle of filaments and/or at least one yarn. Processor 1021 may be communicatively coupled to RAM 1022, ROM 1023, storage 1024, database 1025, I/O devices 1026, and interface 1027. Processor 1021 may be configured to execute sequences of computer program instructions to perform various processes. The computer program instructions may be loaded into RAM 1022 for execution by processor 1021.

RAM 1022 and ROM 1023 may each include one or more devices for storing information associated with operation of processor 1021. For example, ROM 1023 may include a memory device configured to access and store information associated with the computer, including information for identifying, initializing, and monitoring the operation of one or more components and subsystems. RAM 1022 may include a memory device for storing data associated with one or more operations of processor 1021. For example, ROM 1023 may load instructions into RAM 1022 for execution by processor 1021.

Storage 1024 may include any type of mass storage device configured to store information that processor 1021 may need to perform processes consistent with the disclosed embodiments. For example, storage 1024 may include one or more magnetic and/or optical disk devices, such as hard drives, CD-ROMs, DVD-ROMs, or any other type of mass media device.

Database 1025 may include one or more software and/or hardware components that cooperate to store, organize, sort, filter, and/or arrange data used by the computer and/or processor 1021. For example, database 1025 may store computer readable instructions that cause the processor 1021 to adjust the volumetric flow rate of the thermoplastic polymers pumped by each spin pump to achieve a ratio of the thermoplastic polymers to be included in a yarn. It is contemplated that database 1025 may store additional and/or different information than that listed above.

I/O devices 1026 may include one or more components configured to communicate information with a user associated with computer. For example, I/O devices may include a console with an integrated keyboard and mouse to allow a user to maintain a database of digital images, results of the analysis of the digital images, metrics, and the like. I/O devices 1026 may also include a display including a graphical user interface (GUI) for outputting information on a monitor. I/O devices 1026 may also include peripheral devices such as, for example, a printer for printing information associated with the computer, a user-accessible disk drive (e.g., a USB port, a floppy, CD-ROM, or DVD-ROM drive, etc.) to allow a user to input data stored on a portable media device, a microphone, a speaker system, or any other suitable type of interface device.

Interface 1027 may include one or more components configured to transmit and receive data via a communication network, such as the Internet, a local area network, a workstation peer-to-peer network, a direct link network, a wireless network, or any other suitable communication platform. For example, interface 1027 may include one or more modulators, demodulators, multiplexers, demultiplexers, network communication devices, wireless devices, antennas, modems, and any other type of device configured to enable data communication via a communication network.

Various implementations have been described. Nevertheless, it will be understood that various modifications may be made without departing from the spirit and scope of the description. Accordingly, other implementations are within the scope of the following claims.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

The terminology used herein is for the purpose of describing particular implementations only and is not intended to be limiting of the disclosure. As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, when a value is given as "between" a first and second number, the range includes the first and second numbers.

The invention claimed is:

1. A method to produce a BCF yarn comprising:

A. providing N bundles of spun filaments, N being an integer of 2 or more;

B. partially elongating the spun filaments of said N bundles of spun filaments;

C. individually tacking at least a first of said N bundles of partially elongated spun filaments;

D. drawing the spun filaments of said N bundles of tacked and partially elongated spun filaments to a final denier per filament;

E. texturizing said N bundles; and

F. performing a final tacking of said N bundles of spun filaments to provide a BCF yarn.

2. The method according to claim 1, wherein all of said N bundles of spun filaments are tacked individually.

3. The method of claim 1, wherein a length between consecutive tacks on each bundle of said N bundles is between 5 and 50 mm.

4. The method of claim 1, wherein the filaments of at least one of the N bundles of spun filaments has a different color, hue, and/or dyability characteristic as compared to the color, hue, and/or dyability characteristic of another of the N bundles of spun filaments.

5. The method according to claim 4, wherein the filaments of each of the N bundles of spun filaments has a different color, hue, and/or dyability characteristic as compared to the color, hue, and/or dyability characteristic of the other N bundles of spun filaments.

6. A BCF yarn produced according to the method of claim 1.

7. A carpet comprising pile, the pile made with the BCF yarn as recited in claim 6.

8. The method of claim 1, wherein in step E, at least a first bundle of said N bundles of elongated spun filaments is texturized separately from the other of said N bundles of elongated spun filaments.

9. The method according to claim 8, wherein in step E, all of said N bundles of elongated spun filaments are texturized separately.

10. The method of claim 1, wherein in step C, the filaments of all of said N bundles of spun filaments are tacked individually.

11. The method of claim 1, wherein said N bundles of texturized spun filaments of step E are guided over a mixing cam to position bundles relative to each other before the final tacking in step F.

12. The method of claim 11, wherein the mixing cam is rotated while the textured spun filaments are guided over the mixing cam, varying the position of the bundles relative to each other.

13. The method of claim 11, wherein the mixing cam is stationary while the textured spun filaments are guided over the mixing cam.

14. The method according to claim 10, wherein in step C, at least a first bundle of said N bundles of elongated spun filaments is texturized separately from the other of said N bundles of elongated spun filaments.

15. A BCF yarn spinning system comprising:

A. a plurality of spin plates for spinning N bundles of spun filaments, N being an integer of 2 or more;

B. at least one final drawing device to elongate said spun filaments of said N bundles of spun filaments to a final denier per filament;

C. at least one texturizer to texturize said N bundles of elongated spun filaments;

D. a final tacking device to tack said N bundles of texturized spun filaments to provide a BCF yarn, wherein said system is further configured to initially draw said spun filaments of at least one of said N bundles of spun filaments upstream of an initial tacking device upstream of said at least one final drawing device to tack said spun filaments of at least one of said N bundles of spun filaments after or during the partial elongation of the N bundles of spun filaments.

16. The BCF yarn spinning system of claim 15, wherein the at least one texturizer comprises at least a first texturizer and a second texturizer, and at least one of said N bundles of spun filaments is texturized individually from the other N bundles of spun filaments through the first texturizer.

17. The BCF yarn spinning system of claim 15, wherein the at least one texturizer comprises N texturizers, and each of said N bundles of spun filaments are texturized individually from each other through respective N texturizers.

18. The BCF yarn spinning system of claim 15, further comprising an intermediate tacking device disposed between the at least one texturizer and the final tacking device, the intermediate tacking device configured for tacking at least one of said N bundles of texturized spun filaments.

19. The BCF yarn spinning system of claim 18, further comprising a mixing cam disposed between the at least one texturizer and the final tacking device, the mixing cam configured for positioning tacked and texturized bundles relative to each other before reaching the final tacking device.

20. The BCF yarn spinning system of claim 19, wherein the mixing cam is configured to be rotated while the textured spun filaments are guided over the mixing cam, varying the position of the bundles relative to each other before being received by the final tacking device.

21. The BCF yarn spinning system of claim 19, wherein the mixing cam is configured to be held stationary while the textured spun filaments are guided over the mixing cam.

22. The BCF yarn spinning system of claim 15, wherein the filaments of at least one of the N bundles of spun filaments has a different color, hue, and/or dyability characteristic as compared to the color, hue, and/or dyability characteristic of another of the N bundles of spun filaments.

23. The BCF yarn spinning system according to claim 22, wherein the filaments of each of the N bundles of spun filaments has a different color, hue, and/or dyability characteristic as compared to the color, hue, and/or dyability characteristic of the other N bundles of spun filaments.

24. The BCF yarn spinning system of claim 16, further comprising an intermediate tacking device disposed between the at least one texturizer and the final tacking device, the intermediate tacking device configured for tacking at least one of said N bundles of texturized spun filaments.

25. The BCF yarn spinning system of claim 24, further comprising a mixing cam disposed between the at least one texturizer and the final tacking device, the mixing cam configured for positioning tacked and texturized bundles relative to each other before reaching the final tacking device.

* * * * *